US010383435B1

(12) United States Patent
Lundberg et al.

(10) Patent No.: US 10,383,435 B1
(45) Date of Patent: Aug. 20, 2019

(54) DESKING ARRANGEMENT

(71) Applicant: Inscape Corporation, Holland Landing (CA)

(72) Inventors: Olle Lundberg, Stockholm (SE); Richard Flotner, Uxbridge (CA); Zhongyao Fang, Richmond Hill (CA); Peter Woronecki, Holland Landing (CA); David Parshad, Markham (CA)

(73) Assignee: Inscape Corporation, Holland Landing (CA)

( * ) Notice: Subject to any disclaimer, the term of this patent is extended or adjusted under 35 U.S.C. 154(b) by 0 days.

(21) Appl. No.: 15/894,369

(22) Filed: Feb. 12, 2018

(51) Int. Cl.
*A47B 21/06* (2006.01)
*A47B 87/00* (2006.01)

(52) U.S. Cl.
CPC ..... *A47B 21/06* (2013.01); *A47B 87/002* (2013.01); *A47B 2021/066* (2013.01); *A47B 2200/0084* (2013.01); *A47B 2200/12* (2013.01)

(58) Field of Classification Search
CPC ..... A47B 2200/008; A47B 21/06; A47B 2021/062; A47B 2021/064; A47B 2021/066
USPC ..... 108/50.02; 312/223.6
See application file for complete search history.

(56) References Cited

U.S. PATENT DOCUMENTS 4,224,769 A * 9/1980 Ball ..... A47B 21/06 312/140.1
4,600,173 A * 7/1986 Frascaroli ..... A47B 17/00 248/228.6
4,734,826 A * 3/1988 Wilson ..... A47B 21/06 361/729
4,748,913 A * 6/1988 Favaretto ..... A47B 17/00 108/50.02
5,078,055 A * 1/1992 Bellini ..... A47B 13/003 108/64
5,231,562 A * 7/1993 Pierce ..... A47B 21/06 108/50.02
5,901,513 A * 5/1999 Mollenkopf ..... A47B 21/06 108/182
5,971,508 A 10/1999 Deimen et al.
6,021,613 A 2/2000 Reuter et al.
6,202,567 B1 3/2001 Funk et al.
6,283,043 B1 * 9/2001 Stern ..... A47B 13/06 108/50.02
6,435,106 B2 8/2002 Funk et al.
6,528,726 B1 * 3/2003 Jauch ..... A47B 21/06 174/101
6,712,433 B2 3/2004 Hellwig et al.
6,725,784 B2 * 4/2004 Crinion ..... A47B 17/00 108/50.01

(Continued)

*Primary Examiner* — Jose V Chen

(74) *Attorney, Agent, or Firm* — Thorpe North and Western

(57) ABSTRACT

A work bench includes a work surface with a spline assembly supported adjacent work surface. The spline assembly includes a longitudinally extended spline body and a longitudinally extended raceway cover. The spline body has an upper portion and two side arms extending downwardly from the upper portion. The spline body defines a channel for carrying a power track between the two side arms. The raceway cover is configured to attach to the two side arms of the spline body below the power track, and defines a raceway for carrying cables underneath the spline body.

20 Claims, 23 Drawing Sheets

(56) References Cited

U.S. PATENT DOCUMENTS

| | | | | |
|---|---|---|---|---|
| 7,665,255 | B2 * | 2/2010 | Dressendorfer | H02G 3/0456 108/50.02 |
| 7,871,280 | B2 * | 1/2011 | Henriott | A47B 21/06 108/50.02 |
| 8,109,215 | B2 | 2/2012 | Kitada et al. | |
| 8,276,523 | B2 * | 10/2012 | Miller | A47B 21/00 108/50.02 |
| 9,854,903 | B1 * | 1/2018 | Brandenberg | A47B 21/06 |
| 10,117,511 | B2 * | 11/2018 | Gosling | A47B 21/06 |
| 2009/0273260 | A1 * | 11/2009 | Kemp | A47B 21/06 312/223.3 |
| 2013/0061783 | A1 * | 3/2013 | Bennie | A47B 21/06 108/25 |
| 2014/0238277 | A1 * | 8/2014 | Fishman | A47B 37/00 108/25 |
| 2014/0261094 | A1 * | 9/2014 | Parshad | A47B 17/00 108/28 |
| 2014/0261104 | A1 * | 9/2014 | Sherman | A47B 21/06 108/93 |
| 2016/0367025 | A1 * | 12/2016 | Grabowski | A47B 21/06 |
| 2018/0084904 | A1 | 3/2018 | Gosling et al. | |
| 2018/0110327 | A1 * | 4/2018 | Keller | A47B 21/02 |

* cited by examiner

DESKING ARRANGEMENT

SCOPE OF THE INVENTION

This invention relates to work stations, desking arrangements, power and cable distribution arrangements, raceways, leg structures, and support structures preferably for use in office settings and with office furniture components.

BACKGROUND OF THE INVENTION

Various arrangements are known to provide for office furniture provided from modular and interchangeable elements which can be configured into multiple arrangements and configurations and accommodate a wide variety of needs and functions. Such arrangements provide various furniture, such as work stations, for example, with standalone tables, or with two or more work stations provided in proximity as arranged back to back, side to side or spaced supported by various support structures, preferably with power and cable distribution via complementary arrangements as well with capability to accommodate various privacy panels, support shelves, storage cabinets, storage drawers and the like. The present inventor has appreciated that previously known devices suffer numerous disadvantages, typically including undue complexity and overdesign.

SUMMARY OF THE INVENTION

To at least partially overcome these disadvantages of previously known devices the present invention provides arrangements providing for office furniture with interchangeable elements.

In one aspect, the invention provides a work bench. The work bench preferably includes a work surface, and in another aspect a support structure for supporting the work surface. The work bench preferably includes in another aspect a spline assembly adapted to be supported in juxtaposition to the work surface preferably supported by the support structure. The spline assembly preferably includes a longitudinally extended spline body and a longitudinally extended raceway cover. The spline body preferably has an upper portion and two side arms extending downwardly from the upper portion, and defines a channel for carrying a power track between the two side arms. The raceway cover is preferably configured to attach to the two side arms of the spline body, and preferably defines a raceway for carrying cables underneath the spline body.

In a $1^{st}$ aspect, the present invention provides a work bench comprising:

a work surface;

a support structure for supporting the work surface; and a spline assembly supported adjacent to the work surface by the support structure, the spline assembly comprising:

a longitudinally extended spline body with an upper portion and two side arms extending downwardly from the upper portion, the spline body defining a channel for carrying a power track between the two side arms; and a longitudinally extended raceway cover configured to attach to the two side arms of the spline body, the raceway cover defining a raceway for carrying cables underneath the spline body.

In a $2^{nd}$ aspect, the present invention provides the work bench according to the $1^{st}$ aspect, wherein the spline body is supported adjacent to the work surface so as to provide a gap between the spline body and the work surface.

In a $3^{rd}$ aspect, the present invention provides the work bench according to the $2^{nd}$ aspect, wherein the upper portion of the spline body has a flat upper surface with a central groove for receiving a privacy panel.

In a $4^{th}$ aspect, the present invention provides the work bench according to the $3^{rd}$ aspect, wherein the upper portion of the spline body defines a nut slot for receiving a nut, the nut slot being configured so that the nut is longitudinally slidable within the nut slot for attachment to a bolt at a selected location.

In a $5^{th}$ aspect, the present invention provides the work bench according to the $4^{th}$ aspect, wherein the upper portion of the spline body has two laterally spaced sidewalls that extend downwards from the flat upper surface;

wherein the nut slot extends longitudinally along a first one of the sidewalls; and wherein a second nut slot extends longitudinally along a second one of the sidewalls.

In a $6^{th}$ aspect, the present invention provides the work bench according to the $4^{th}$ or $5^{th}$ aspect, wherein the nut slot is configured for mounting an accessory proximate to the work surface at the selected location using the nut and the bolt.

In a $7^{th}$ aspect, the present invention provides the work bench according to the $6^{th}$ aspect, wherein the accessory comprises a shelf, a tray, or a bracket.

In an $8^{th}$ aspect, the present invention provides the work bench according to the $6^{th}$ or $7^{th}$ aspect, wherein the nut slot is located below the work surface so that the accessory extends up through the gap when mounted at the selected location.

In a $9^{th}$ aspect, the present invention provides the work bench according to any one of the $2^{nd}$ to $8^{th}$ aspects, wherein the spline body is configured to slidably receive the power track into the channel by inserting the power track upwards between the two side arms while the raceway cover is unattached to the side arms.

In a $10^{th}$ aspect, the present invention provides the work bench according to the $9^{th}$ aspect, wherein a first one of the side arms has a side slot open at a lower end of the first side arm, the side slot being configured to receive a laterally extending power socket of the power track when the power track is inserted upwards into the channel.

In an $11^{th}$ aspect, the present invention provides the work bench according to the $10^{th}$ aspect, wherein the side slot is located proximate to the gap so that the power socket is accessible from the work surface through the gap.

In a $12^{th}$ aspect, the present invention provides the work bench according to the $10^{th}$ or $11^{th}$ aspect, wherein a second one of the side arms has a second side slot open at a lower end of the second side arm, the second side slot being configured to receive a second laterally extending power socket of the power track when the power track is inserted upwards into the channel.

In a $13^{th}$ aspect, the present invention provides the work bench according to any one of the $2^{nd}$ to $12^{th}$ aspects, wherein the upper portion of the spline body has an attachment mechanism for carrying the power track within the channel.

In a $14^{th}$ aspect, the present invention provides the work bench according to any one of the $2^{nd}$ to $13^{th}$ aspects, wherein the spline assembly further comprises a retainer configured to hang from the power track, the retainer being configured to hold the cables in place underneath the spline body when the raceway cover is unattached to the side arms.

In a $15^{th}$ aspect, the present invention provides the work bench according to the $14^{th}$ aspect, wherein the retainer is positioned within the raceway and is configured to hold the cables within the raceway, between the raceway cover and the side arms.

In a 16$^{th}$ aspect, the present invention provides the work bench according to the 14$^{th}$ or 15$^{th}$ aspect, further comprising at least one additional retainer, wherein the retainers are longitudinally spaced from one another within the raceway.

In a 17$^{th}$ aspect, the present invention provides the work bench according to any one of the 14$^{th}$ to 16$^{th}$ aspects, wherein the retainer has two laterally extending arms that are configured to support data cables, and a central slotway that is configured to support a power cable.

In an 18$^{th}$ aspect, the present invention provides the work bench according to any one of the 2$^{nd}$ to 17$^{th}$ aspects, wherein each of the two side arms has a longitudinally extended groove for attaching the raceway cover to the spline body with a friction fit.

In a 19$^{th}$ aspect, the present invention provides the work bench according to any one of the 1$^{st}$ to 18$^{th}$ aspects, wherein the raceway cover is open at its longitudinal ends.

In a 20$^{th}$ aspect, the present invention provides the work bench according to the 19$^{th}$ aspect, wherein the support structure comprises a support beam, the raceway cover being normal to the support beam; and wherein the raceway cover extends below a height of the support beam so as to allow the cables to pass horizontally under the support beam from the open end of the raceway cover.

In a 21$^{st}$ aspect, the present invention provides the work bench according to any one of the 2$^{nd}$ to 18$^{th}$ aspects, further comprising a second work surface that is supported by the support structure adjacent to the spline body so as to provide a second gap between the second work surface and the spline body, with the spline body arranged between the work surface and the second work surface.

In a 22$^{nd}$ aspect, the present invention provides the work bench according to the 21$^{st}$ aspect, wherein the support structure comprises a first leg assembly attached to a first longitudinal end of the spline body and a second leg assembly attached to a second longitudinal end of the spline body, each of the first and second leg assemblies comprising a transverse support beam extending laterally between a front leg and a back leg;

wherein the work surface is supported between the transverse support beam of the first leg assembly and the transverse support beam of the second leg assembly at a front side of the work bench; and wherein the second work surface is supported between the transverse support beam of the first leg assembly and the transverse support beam of the second leg assembly at a back side of the work bench.

In a 23$^{rd}$ aspect, the present invention provides the work bench according to the 22$^{nd}$ aspect, further comprising a third leg assembly, a second spline assembly, a third work surface, and a fourth work surface;

wherein the first longitudinal end of the spline body of the spline assembly is attached to a first side of the transverse support beam of the first leg assembly;

wherein the second longitudinal end of the spline body of the spline assembly is attached to a first side of the transverse support beam of the second leg assembly;

wherein the first longitudinal end of the spline body of the second spline assembly is attached to a second side of the transverse support beam of the second leg assembly;

wherein the second longitudinal end of the spline body of the second spline assembly is attached to a first side of the transverse support beam of the third leg assembly;

wherein the third work surface is supported between the transverse support beam of the second leg assembly and the transverse support beam of the third leg assembly at the front side of the work bench;

wherein the fourth work surface is supported between the transverse support beam of the second leg assembly and the transverse support beam of the third leg assembly at the back side of the work bench; and wherein the raceway of the spline assembly and the raceway of the second spline assembly extend below a bottom surface of the transverse support beam of the second leg assembly, so as to allow the cables carried by the raceways to extend between the spline assembly and the second spline assembly underneath the transverse support beam.

In a 24$^{th}$ aspect, the present invention provides the work bench according to any one of the 1$^{st}$ to 13$^{th}$ aspects, wherein the spline body and the raceway cover are each one-piece plastic extrusions.

In a 25$^{th}$ aspect, the present invention provides a spline assembly comprising:

a longitudinally extended spline body with an upper portion and two side arms extending downwardly from the upper portion, the spline body defining a channel for carrying a power track between the two side arms; and a longitudinally extended raceway cover configured to attach to the two side arms of the spline body, the raceway cover defining a raceway for carrying cables underneath the spline body.

In a 26$^{th}$ aspect, the present invention provides a work bench comprising:

a work surface;

a support structure for supporting the work surface; and a spline assembly supported adjacent to the work surface by the support structure so as to provide a gap between the spline body and the work surface, the spline assembly comprising:

a longitudinally extended spline body with an upper portion and two side arms extending downwardly from the upper portion, the spline body defining a channel between the two side arms;

a power track positioned within the channel, the power track having at least one power outlet that is accessible from the work surface through the gap; and a longitudinally extended raceway cover configured to attach to the two side arms of the spline body, the raceway cover defining a raceway for carrying cables underneath the power track;

wherein the upper portion of the spline body has a flat upper surface with a central groove for receiving a privacy panel;

wherein the upper portion of the spline body defines a nut slot for receiving a nut, the nut slot being configured so that the nut is longitudinally slidable within the nut slot for attachment to a bolt at a selected location;

wherein the side arms have at least one side slot open at a lower end of the side arms, the at least one side slot being configured to receive the at least one power outlet of the power track;

wherein the upper portion of the spline body has an attachment mechanism for carrying the power track within the channel;

wherein the spline assembly further comprises a retainer configured to hang from the power track, the retainer being configured to hold the cables within the raceway, between the raceway cover and the side arms;

wherein the support structure comprises a first leg assembly attached to a first longitudinal end of the spline body and a second leg assembly attached to a second longitudinal end of the spline body, each of the first and second leg assemblies comprising a transverse support beam extending laterally between a front leg and a back leg; and wherein the raceway cover has open longitudinal ends that extend below a height of the transverse support beams so as to allow the cables to pass horizontally under the transverse support beams from the open ends of the raceway cover.

In a $27^{th}$ aspect, the present invention provides a leg assembly comprising:

a first leg having a top end and a bottom end;

a second leg having a top end and a bottom end;

a first leg cap attached to the top end of the first leg;

a second leg cap attached to the top end of the second leg; and a transverse support beam extending laterally between the first leg cap and the second leg cap, the transverse support beam comprising a nut slot for receiving a nut, the nut slot being configured so that the nut is slidable within the nut slot for attachment to a bolt at a selected location.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
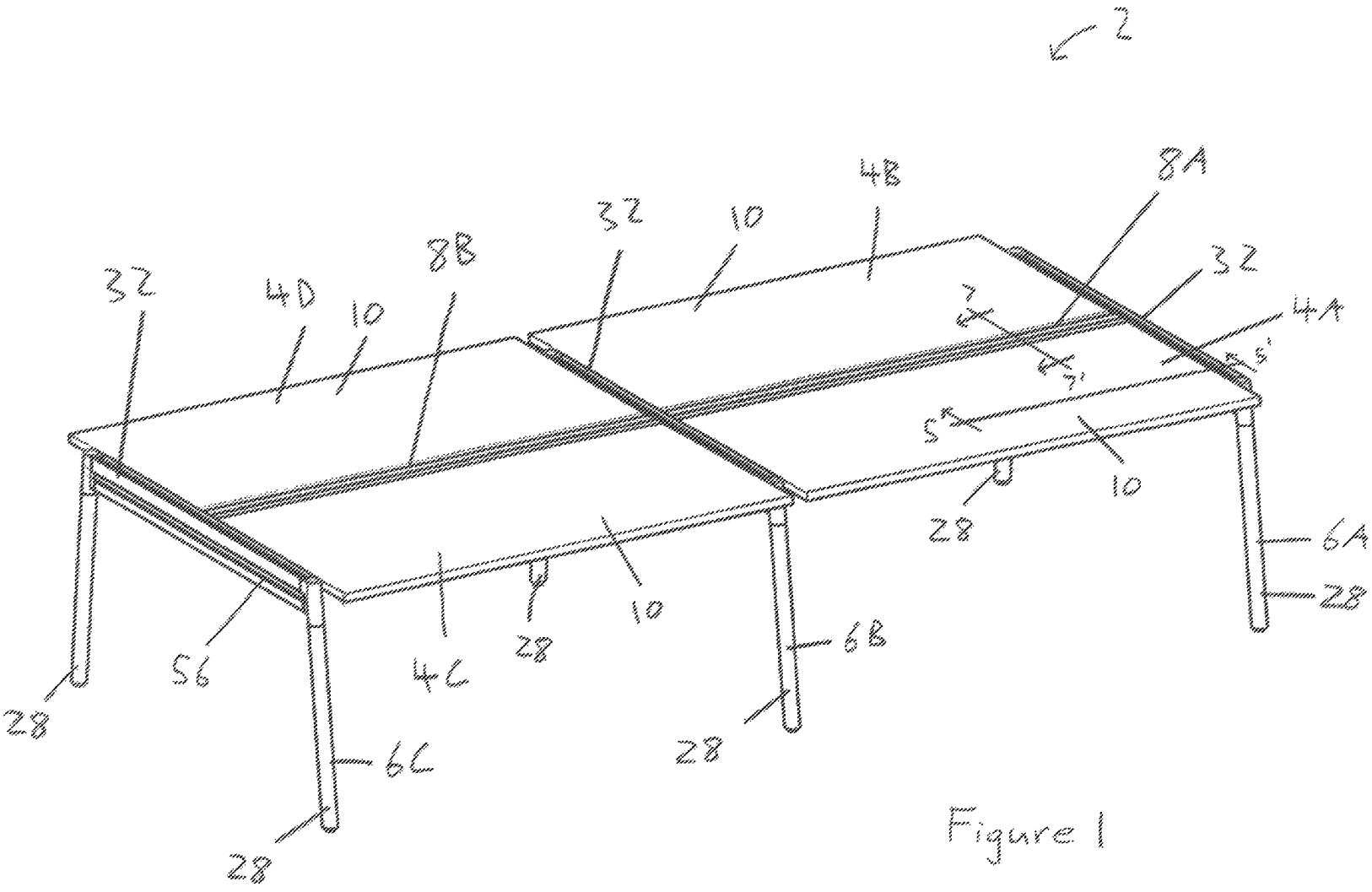
FIG. 1 shows a perspective view from above of a first embodiment of a work bench in accordance with the present invention in a first configuration.

The work bench 2 shown in FIG. 1 includes four work surfaces 4A, 4B, 4C, 4D; three leg assemblies 6A, 6B, 6C; and two spline assemblies 8A, 8B. Each work surface 4A, 4B, 4C, 4D is a rectangular desktop with flat top 10 and bottom 12 surfaces, and is preferably sized to provide a work space for one worker. The work surfaces 4A, 4B, 4C, 4D are constructed from any suitable material, such as metal, wood, or plastic.

Each work surface 4A, 4B, 4C, 4D extends longitudinally between two leg assemblies 6A, 6B, 6C. More specifically, work surface 4A extends longitudinally between leg assembly 6A and leg assembly 6B at the front side of the work bench 2; work surface 4B extends longitudinally between leg assembly 6A and leg assembly 6B at the back side of the work bench 2; work surface 4C extends longitudinally between leg assembly 6B and leg assembly 6C at the front side of the work bench 2; and work surface 4D extends longitudinally between leg assembly 6B and leg assembly 6C at the back side of the work bench 2.

Figure 2:
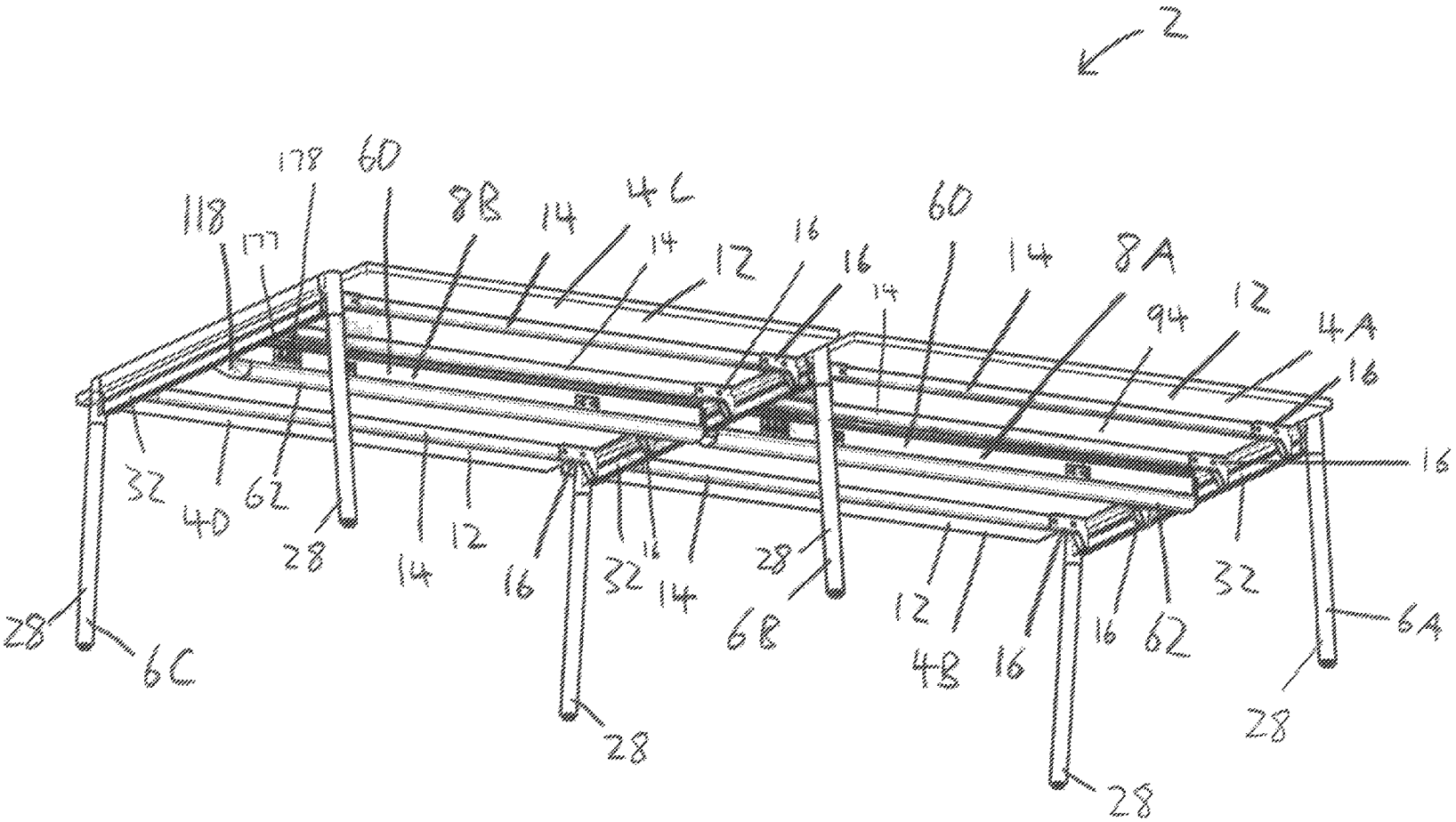
FIG. 2 shows a perspective view from below of the work bench of FIG. 1.
Figure 3:
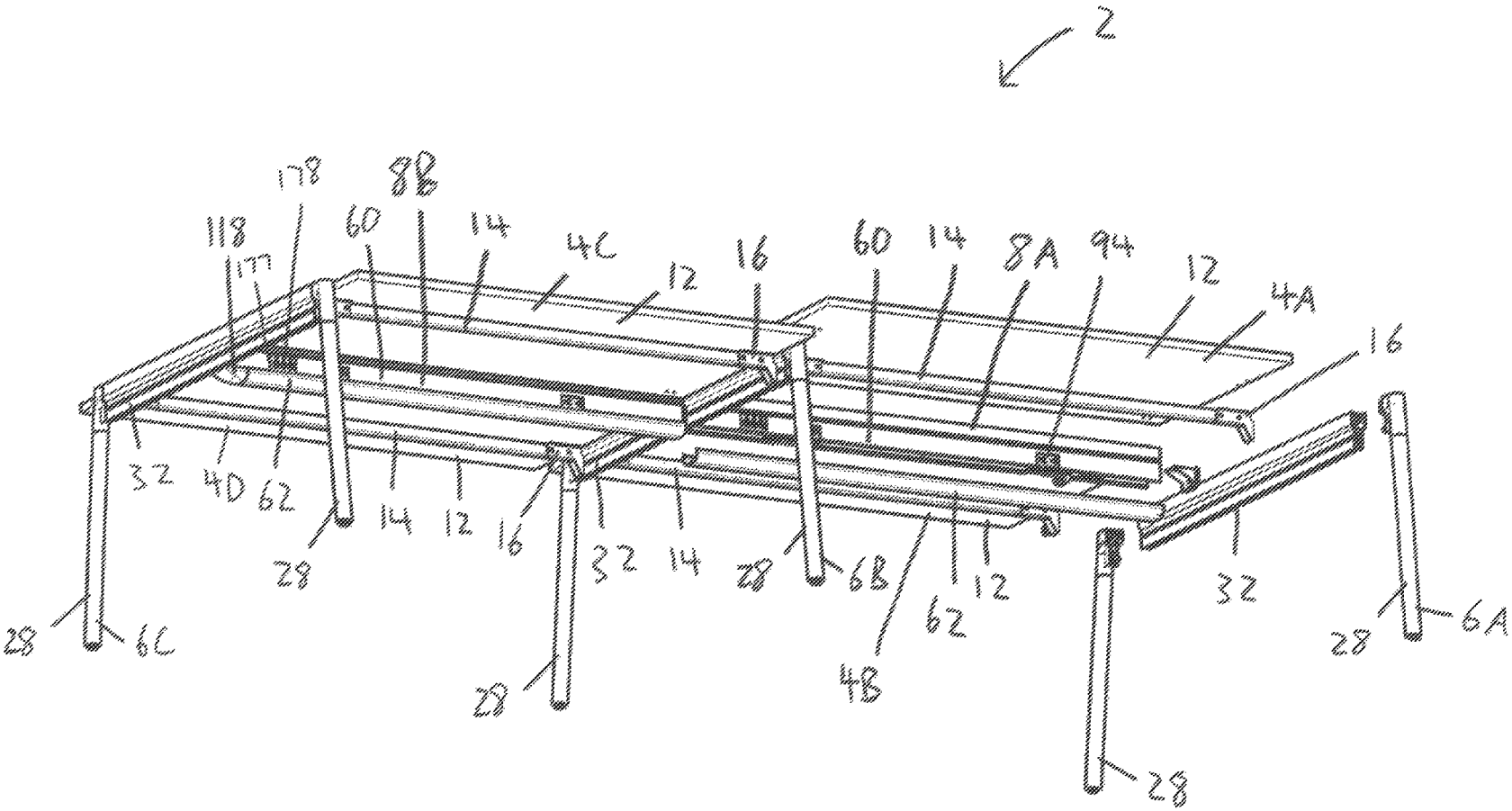
FIG. 3 shows a partially exploded perspective view from below of the work bench of FIG. 1.

As is shown in FIG. 2, each work surface 4A, 4B, 4C, 4D is supported by a pair of longitudinal support beams 14 that extend longitudinally under the bottom surface 12 of the work surface 4A, 4B, 4C, 4D. Each of the two beams 14 are preferably identical. FIG. 2 is the only Figure that shows both the longitudinal support beams 14 supporting each work surface 4A, 4B, 4C, and 4D. For ease of illustration and understanding in FIGS. 3, 4 and 6 only one of the two beams 14 is shown. However it is to be understood that as in FIG. 2 there are two transversely spaced longitudinal support beams 14 supporting each work surface 4A, 4B, 4C, 4D to provide stability and strength.

Figure 6:
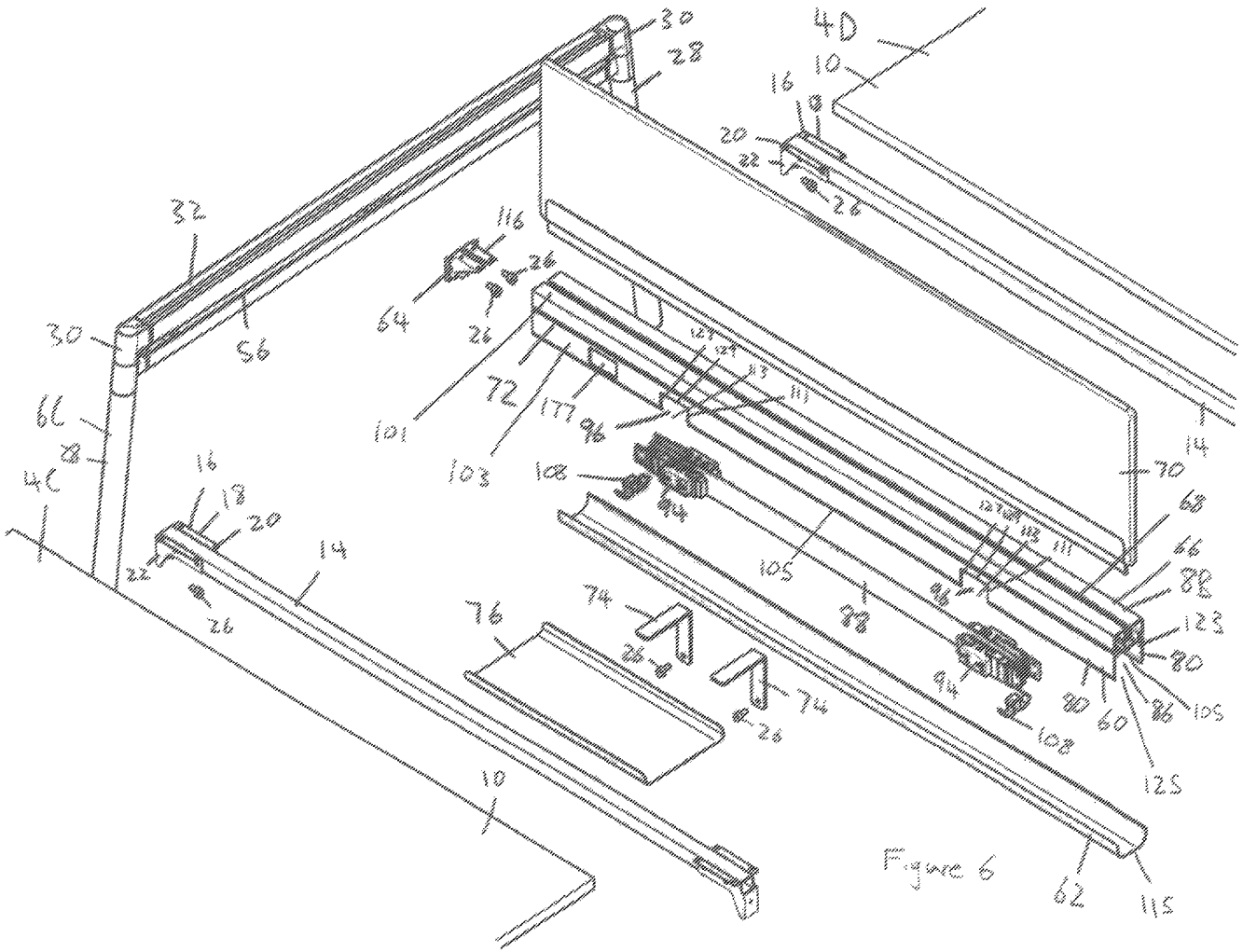
FIG. 6 shows an exploded perspective view from above of a left hand side portion of the work bench in FIG. 1 including a center privacy panel 70 and a shelving unit 76 and brackets 74 not shown on FIG. 1.

Each end of each longitudinal support beam 14 is received within a mounting bracket 16. The mounting brackets 16 have horizontal flanges 18 that are configured to sit squarely against the bottom surface 12 of one of the work surfaces 4A, 4B, 4C, 4D. As best seen in FIG. 6, the horizontal flanges 18 have holes 20 for receiving screws or bolts to attach the mounting bracket 16 to the bottom surface 12 of the corresponding work surface 4A, 4B, 4C, 4D. The mounting brackets 16 also have terminal extensions 22 that project downwardly from the longitudinal beam 14. Each terminal extension 22 has a bolt hole 24 for receiving a bolt 26 to attach the mounting bracket 16 to one of the leg assemblies 6A, 6B, 6C. When assembled, the leg assemblies 6A, 6B, 6C support the longitudinal support beams 14, which in turn support the work surfaces 4A, 4B, 4C, 4D at the desired height to provide work spaces for workers to use while standing and/or sitting.

Figure 4:
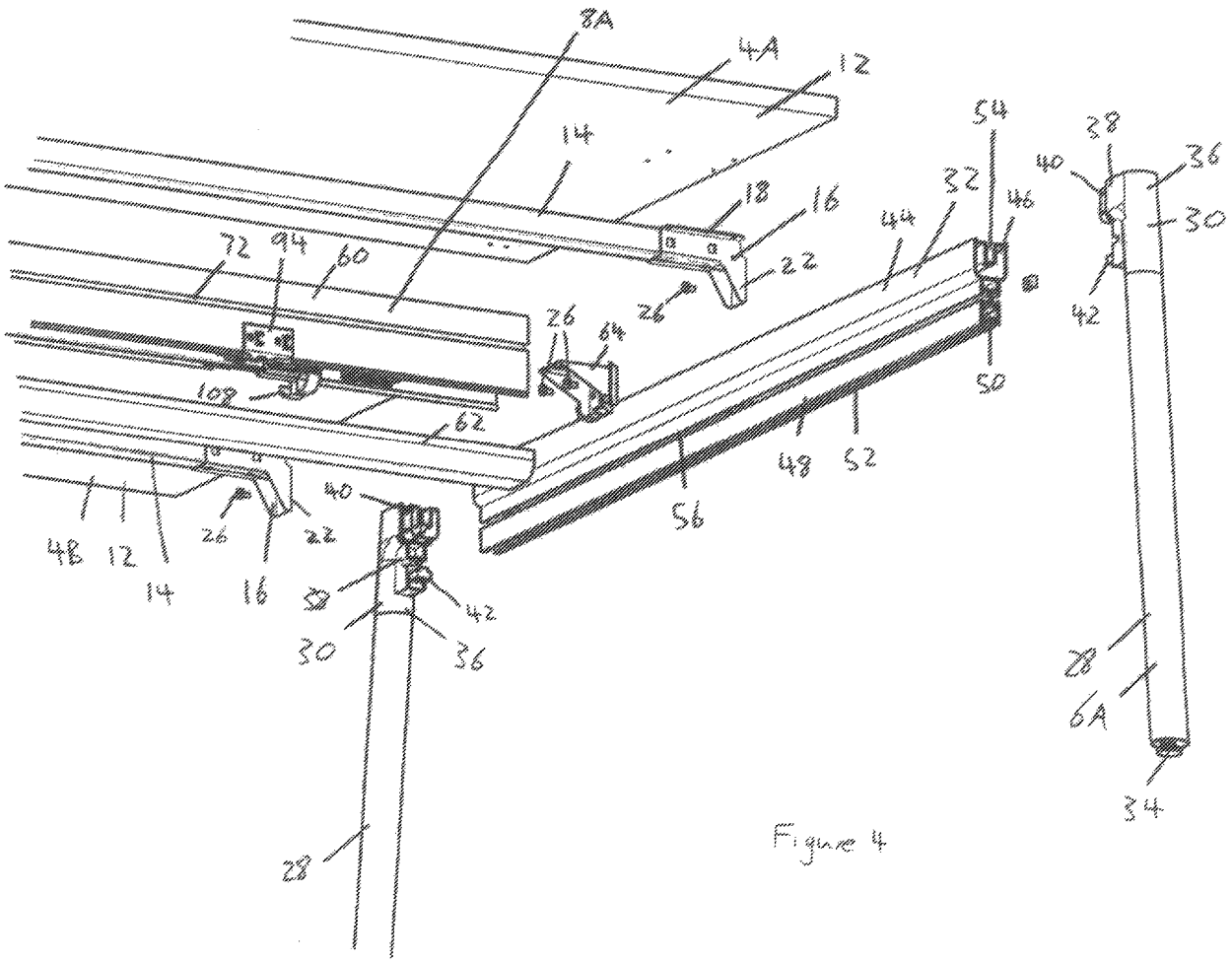
FIG. 4 shows an enlarged view of a right hand side portion of the work bench in FIG. 3.

As seen in FIG. 4, each leg assembly 6A, 6B, 6C includes two cylindrical legs 28, two leg caps 30, and one transverse support beam 32. Each leg 28 has a foot 34 at its lower end that contacts the floor. The feet 34 may be provided with a soft bottom surface to prevent the work bench 2 from scratching the floor and/or a high-friction bottom surface to prevent the work bench 2 from sliding. Optionally, the feet 34 may be configured to be bolted to the floor. Preferably, each foot 34 has an adjustable height mechanism that can be independently set to compensate for a slanted or uneven floor, so that the work surfaces 4A, 4B, 4C, 4D remain flat and stable. For example, the feet 34 could be connected to the lower ends of the legs 28 using a threaded connection so that, by turning the feet 34 in a clockwise or counter clockwise direction, they can be moved up or down.

The leg caps 30 are best shown in FIG. 4 as each comprising a cylindrical sleeve 36 with a side connector 38. The cylindrical sleeve 36 is hollow and has an open bottom for receiving the upper end of a leg 28 therein. The leg 28 may optionally be held in place within the cylindrical sleeve 36 by friction, or may be held in place by a threaded connection, a bolt, a screw, or the like. The side connector 38 extends out from the side of the cylindrical sleeve 36 for connecting to the transverse support beam 32, and includes a U-shaped upper protruding member 40 and an inverted T-shaped lower protruding member 42.

Figure 5:
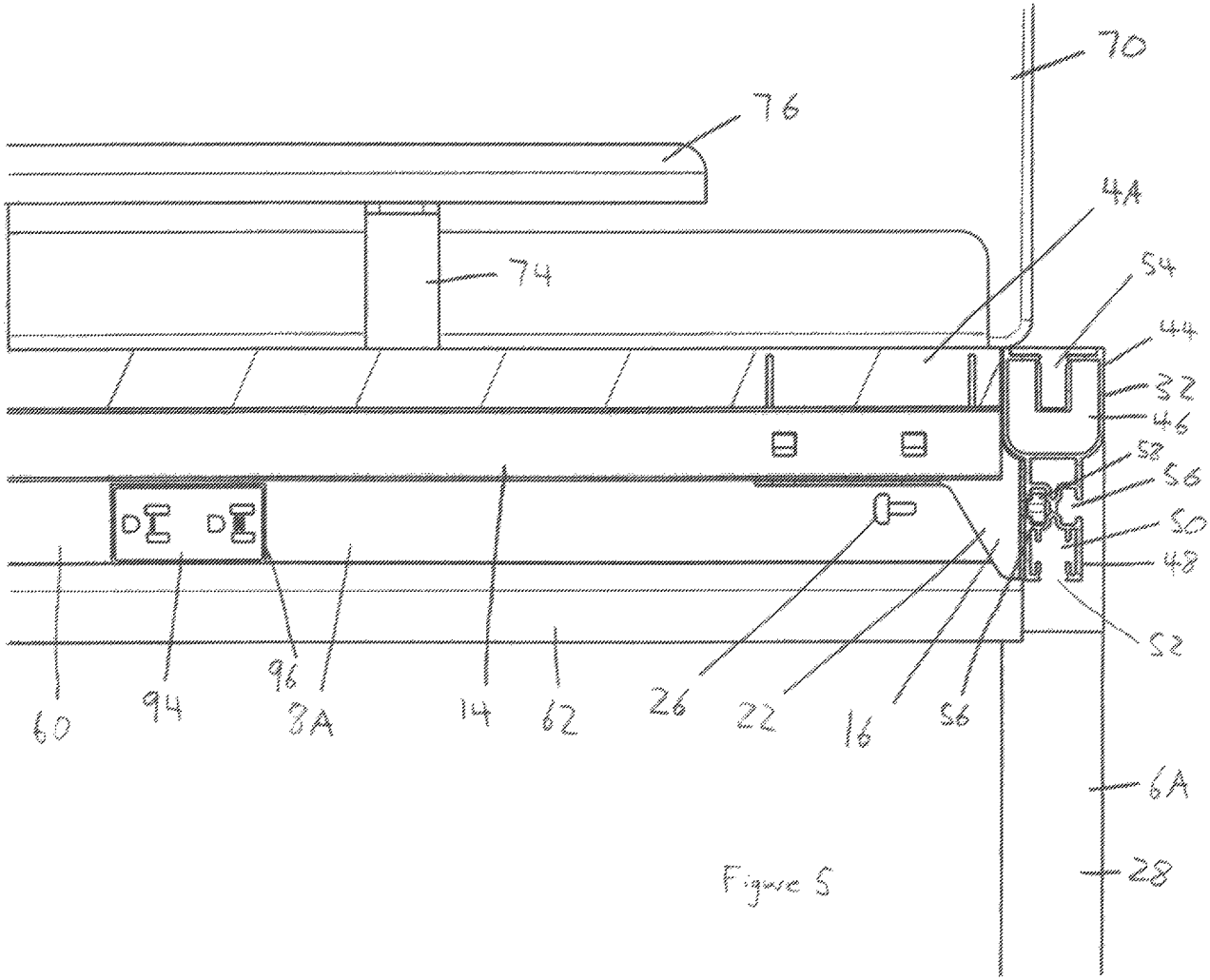
FIG. 5 shows a cross-sectional front view of the work bench of FIG. 1 along section line 5-5' in FIG. 1.
Figure 12:
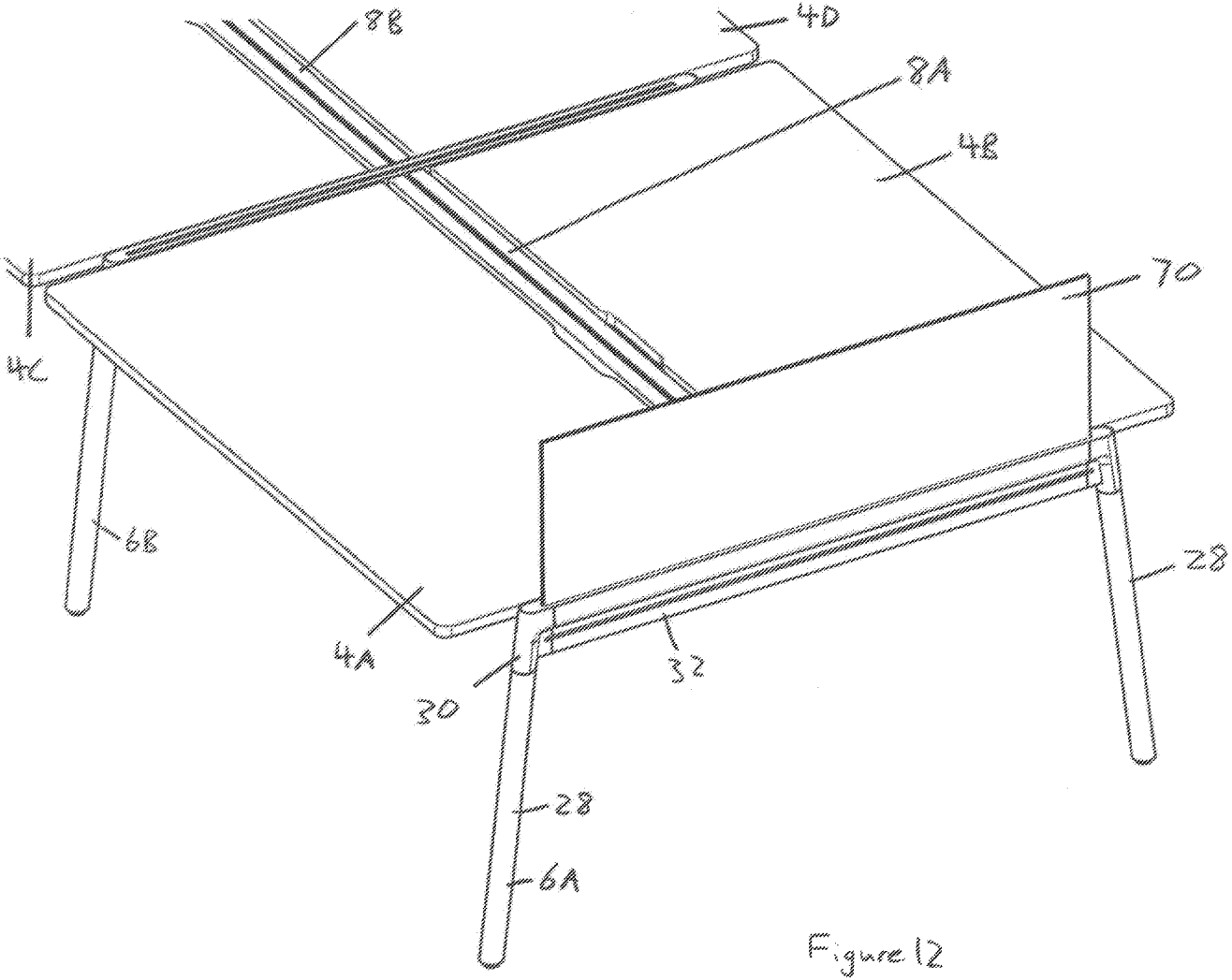
FIG. 12 shows a perspective view of the work bench of FIG. 1 including a lateral privacy panel 70 in a third configuration.

The transverse support beam 32 is preferably formed by extrusion from metal. The transverse support beam 32 has a U-shaped upper portion 44 that defines an upper cavity 46 and a lower portion 48 that defines a lower cavity 50, as shown in FIGS. 4 and 5. The upper cavity 46 and the lower cavity 50 are respectively configured to receive the U-shaped upper protruding member 40 and the inverted T-shaped lower protruding member 42 of a leg cap 30 into each of their ends. The lower portion 48 of the transverse support beam 32 has a downwardly facing groove 52 that is open to the lower cavity 50. To hold the lower protruding member 42 of the leg cap 30 in place within the lower cavity 50, a bolt (not shown) can be inserted upwards through the downwardly facing groove 52 into the lower protruding member 42. The upper portion 44 of the transverse support beam 32 likewise defines an upwardly facing groove 54. The upwardly facing groove 54 can optionally be used to carry a privacy panel 70, as shown in FIG. 12. The downwardly facing groove 52 is also optionally used to carry a modesty panel (not shown) similar to that shown in FIG. 12 that shields a worker's legs from view. To further strengthen the connection between the leg caps 30 and the transverse support beam 32, the upwardly facing groove 54 may optionally include holes (not shown) for inserting bolts downwardly into the upper protruding members 40 of the leg caps 30.

The lower portion 48 of the transverse support beam 32 also defines two laterally spaced nut slots 56. The nut slots 56 extend the entire length of the transverse support beam 32, and are configured to slidably receive nuts 58 therein. The nuts 58 are slidable within the nut slots 56 to a desired location, where they can be used to attach components to the transverse support beam 32 using a bolt 26. For example, as seen in FIG. 5 the mounting bracket 16 of the longitudinal support beam 14 is attached to the transverse support beam 32 by inserting a bolt 26 through the terminal extension 22 of the mounting bracket 16 and into a nut 58 positioned within one of the nut slots 56. As seen in FIG. 5, two nut slots 56 are provided so that work surfaces 4A, 4B, 4C, 4D can be supported on either side of the transverse support beam 32, such as in the leg assembly 6B shown in FIG. 1.

The nut slots 56 are also used to mount center spline assemblies 8A, 8B to the transverse support beams 42. In particular, a spline mounting bracket 64 is attached to each end of each center spline assembly 8A, 8B, and the spline mounting brackets 64 are each attached to a transverse support beam 32 by inserting two bolts 26 through the spline mounting bracket 64 and into two nuts 58 positioned within one of the nut slots 56, similarly to the mounting bracket 16. The spline mounting bracket 64 is best seen in FIG. 6.

Figure 7:
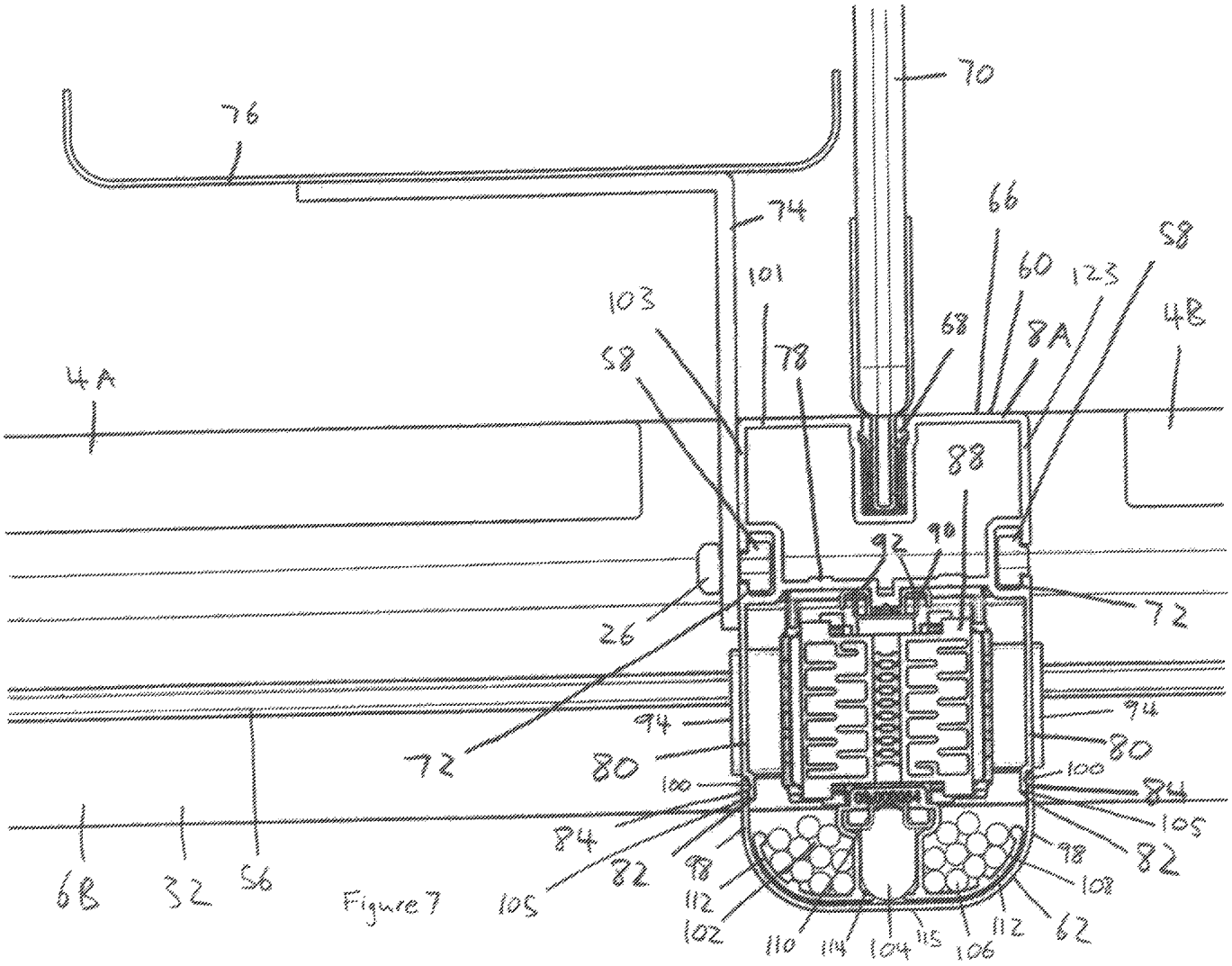
FIG. 7 shows a cross-sectional side view of the work bench along section line 7-7' in FIG. 1 including the center privacy panel 70 and the shelving unit 76 and brackets 74 shown on FIG. 6.
Figure 8:
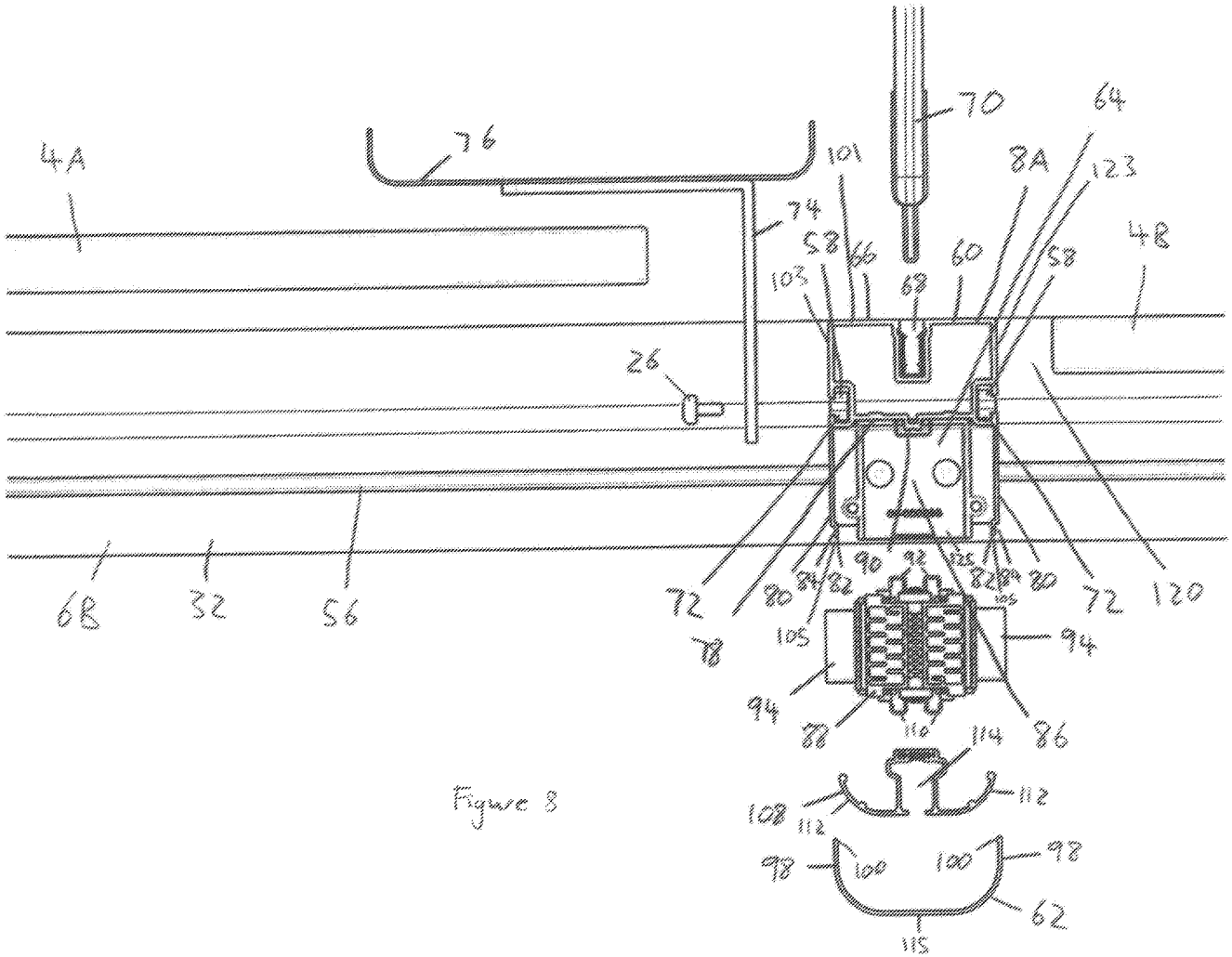
FIG. 8 shows the same cross-sectional side view as in FIG. 7 but partially exploded.
Figure 9:
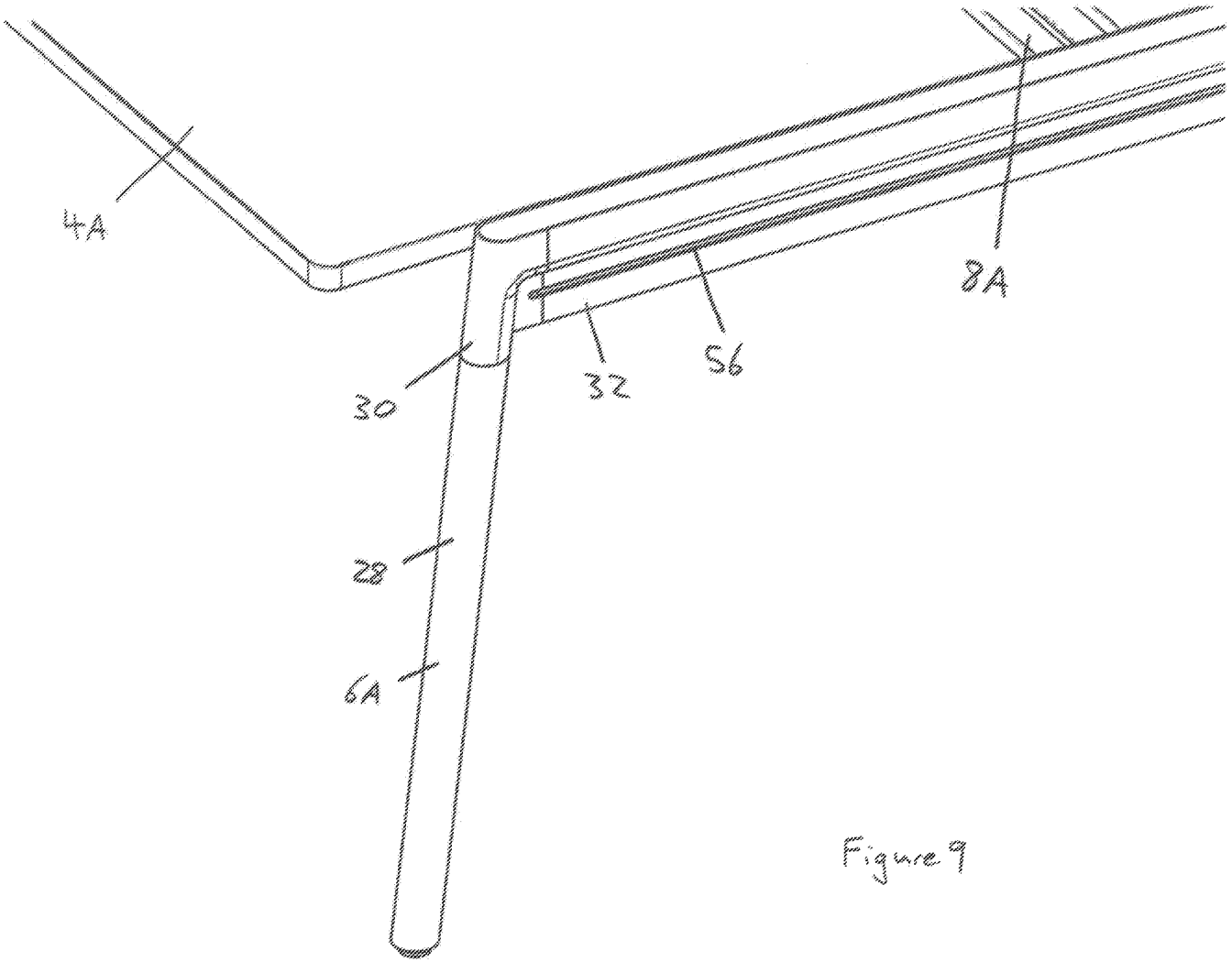
FIG. 9 shows an enlarged perspective view of the work bench of FIG. 1 showing portions of a right side leg assembly.
Figure 10:
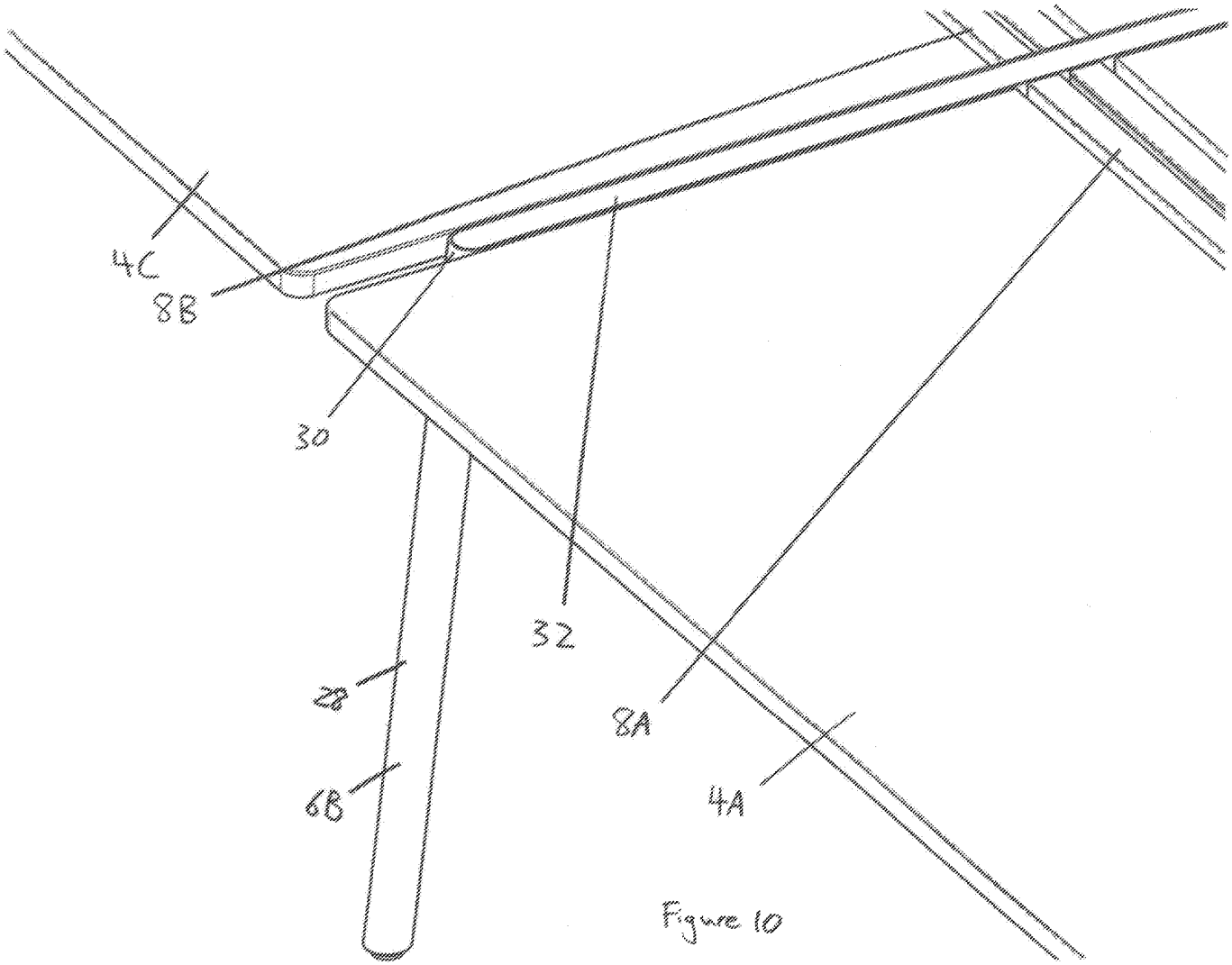
FIG. 10 shows an enlarged perspective view of the work bench of FIG. 1 showing portions of a center leg assembly.

As shown in FIGS. 6 to 8, each center spline assembly 8A, 8B includes a longitudinally extended body 60 and a longitudinally extended raceway cover 62. The body 60 is preferably formed by extrusion as a single extrusion, preferably from metal.

The body 60 has a top wall 101 and a pair of side walls 103 and 123 that extend in the same direction away from the top wall 101 to outer distal ends 105 of the side walls. An intermediate junction or transverse wall 78 bridges between the side walls spaced from the top wall 101 intermediate the top wall 101 and the distal ends 105 of the side walls 103 and 123. A cavity or central channel 86 is defined between the side walls 103 and 123 outwardly of the transverse wall 78 that is open outwardly through an opening 125 between the distal ends 105 of the side walls 103 and 123.

The top wall 101 has a flat upper surface 66 with an upwardly opening central groove 68. The central groove 68 is configured to receive a privacy panel 70 as shown for example in FIG. 7.

The side walls 103 and 123 provide between the top wall 101 and the transverse wall 78 two laterally spaced spline nut slots 72, similar to the nut slots 56 of the transverse support beam 32, one on each of the side walls 103 and 123 open laterally outwardly. The spline nut slots 72 extend the entire length of the body 60 of the center spline assembly 8A, 8B, and are configured to slidably receive nuts 58 therein. The spline nut slots 72 can be used to hold attachments, such as the L-shaped bracket 74 for the shelving unit 76 shown in FIG. 7, by sliding a nut 56 to the desired mounting position within the spline nut slot 72 and inserting a bolt 26 through the bracket 74 and into the nut 56. Having spline nut slots 72 on both sides of the center spline assembly 8A, 8B permits attachments such as the shelving unit 76 to be mounted in proximity to the work surfaces 4A, 4B, 4C, 4D on either side of the center spline assembly 8A, 8B.

The side walls 103 and 123 extend downwardly from the transverse wall 78 and spline nut slots 72 to form two side arms 80 each with a lower edge 82 at the distal end 105 of each side wall 103 and 123. As best seen in FIG. 6, each side arm 80 has two rectangular side slots 96 extending laterally through each side arm 80. Each rectangular side slot 96 extends longitudinally between a first end edge 111 and a second end edge 127. Each rectangular side slot 96 is open through the lower edge 82 via an outer lower slot opening 113 open through the lower edge 82, and extends between the outer slot opening 113 and an inner edge 129 spaced from the outer slot opening 113. The inner edge 129 is outwardly of the transverse wall 78 and the spline nut slots 72. As shown in FIGS. 7 and 8, the lower edge 82 of each side arm 80 of side walls 103 and 123 has an inwardly deflected grooved connector 84.

The transverse wall 78 and the two side arms 80 define a central channel 86 that is open between the lower edges 82 of the side arms 80. The central channel 86 is configured to receive a power track 88 therein by sliding the power track 88 inwardly, that is upwardly as seen in the Figures, through the opening 125 between the two side arms 80, and coupling the power track 88 to the body 60 within the central channel 86 with the power outlets 94 engaged within the side slots 96. The transverse wall 78 is provided with attachment members 90 that are configured to attach to corresponding attaching members 92 located on the top surface of the power track 88 to hold the power track 88 in place within the central channel 86, preferably forming a snap friction fit connection. The power track 88 has four power outlets 94 that extend laterally outwards from the power track 88 an extent at least equal to the width between the two side arms 80. The side slots 96 are configured to receive the power outlets 94 when the power track 88 is slid inwardly, that is upwardly, into the central channel 86 with each power outlet 94 sliding upwardly through the lower slot opening of a respective side slot 96. The power outlets 94 are accessible to users of the work bench 2 laterally outwardly of each of the two side arms 80.

The central channel 86 is configured to attach to the spline mounting brackets 64 to mount each center spline assembly 8A, 8B between two adjacent of the leg assemblies 6A, 6B, 6C. In particular, the central channel 86 is configured to receive horizontally extended connectors 116 of the spline mounting brackets 64 into each of its ends, so that the transverse wall 78 rests on top of the horizontally extended connectors 116. Optionally, the transverse wall 78 has vertically extending holes (not shown) for inserting screws, bolts, or the like into the horizontally extended connectors 116 to provide a secure connection.

The raceway cover 62 is preferably formed as a single extrusion preferably of metal or plastic, and has an elongated U-shaped construction with a central bight portion 115 from which two upwardly extending coupling arms 98 extend. The end of each coupling arm 98 has an inwardly projecting ridge 100 that is configured to fit within the grooved connectors 84 of the side arms 80 of the body 60 in a friction fit. Preferably, the raceway cover 62 is selectively removable from the side arms 80 by manually deflecting the coupling arms 98 away from the grooved connectors 84.

When connected to the side arms 80, the raceway cover 62 defines a raceway 102 for carrying cables 104, 106 underneath the body 60. For example, the raceway 102 may be used to carry a power cable 104 for the power track 88 and data cables 106 for telecommunication as shown in FIG. 7. Preferably, the center spline assembly 8A, 8B also includes one and preferably at least two cable retainers 108 at longitudinally spaced locations along the body 60. The cable retainers 108 preferably are secured to the power track as by clipping as in a snap friction fit manner on to the bottom surface of the power track 88, preferably onto snap fit connectors 110 on the bottom surface of the power outlets 94 of the power track 88.

The cable retainers 108 each have two laterally extending arms 112 with a central slotway 114 defined therebetween. During assembly or maintenance, the cable retainers 108 are used to hold the cables 104, 106 in place underneath the body 60 while the raceway cover 62 is removed. The power cable 104 is held in the central slotway 114 and the data cables 106 sit on the laterally extending arms 112.

The raceway cover 62 preferably extends down past the bottom of the transverse support beam 32, as can be best seen in FIGS. 2 and 7. This allows the cables 104, 106 to pass horizontally underneath the transverse support beam 32 between adjacent raceways 102. Because of the uniform U-shaped construction of the raceway covers 62, the raceways 102 are open at their longitudinal ends, thus permitting the cables 104, 106 to pass freely therebetween. Optionally, end caps 118 as seen on FIG. 2 may be placed over the terminal ends of the raceways 102 to cover up the cables 104, 106 and to discourage unauthorized access to the raceways 102. An intermediate raceway cover extender (not shown) could also optionally be provided to span the gap between adjacent raceways covers 62 under the transverse support beam 32 of the leg assembly 6B so that the cables 104, 106 remain hidden as they traverse under this or any other one of the transverse beams 32.

As best seen in FIGS. 2 and 6, each side arm 80 has a rectangular side opening 177 extending laterally through each side arm 80. Each rectangular side opening 177 is adapted to receive a correspondingly sized cable outlet 178 accessible to users of the work bench 2 laterally outwardly of each of the two side arms 80 for connection as to communication ports carried by the cable outlet 178. The cable outlet 178 is connected to communication cables that are carried in the raceway between the body 60 and the raceway cover 62.

The work bench 2 advantageously incorporates a minimal number of modular parts, allowing for flexible assembly. For example, in the work bench 2 as assembled in FIG. 1, each of the three leg assemblies 6A, 6B, 6C has an identical construction, regardless of whether it is positioned at the end or in the middle of the bench 2. The center spline assemblies 8A, 8B furthermore provide a compact and highly functional construction with a minimal number of parts, including functions such as providing power outlets 94, carrying cables 104, 106, mounting a wide variety of attachments, and supporting a privacy panel 70. The use of nut slots 56, 72 in both the leg assemblies 6A, 6B, 6C and the center spline assemblies 8A, 8B further reduces the number of different parts that are needed, and further increases the configurability of the work bench 2 by permitting the same parts to be mounted at different locations.

The work bench 2 as shown in FIG. 1 has been assembled to provide four work spaces by arranging and supporting two work surfaces 4A, 4B between leg assemblies 6A, 6B, and two work surfaces 4C, 4D between leg assemblies 6B, 6C. The two center spline assemblies 8A, 8B are arranged and supported between leg assemblies 6A, 6B and 6B, 6C, respectively. Center spline assembly 8A is positioned between work surfaces 4A, 4B so as to provide functions such as supplying power and mounting attachments in proximity to each of the work surfaces 4A, 4B, as well as optionally carrying a privacy panel 70 therebetween. As best shown in FIG. 7, the work surfaces 4A, 4B are supported adjacent to the center spline assembly 8A with a gap 120 therebetween. The gap 120 provides a passage for accessing the center spline assembly 8A from the work surfaces 4A, 4B. The gap 120 may be used, for example, to run power cables from the work surfaces 4A, 4B to the power outlets 94. Attachments such as the L-shaped bracket 74 can also extend through the gap 120 as seen on FIG. 7 so as to be accessible from the work surfaces 4A, 4B. Center spline assembly 8B is likewise positioned between work surfaces 4C, 4D with a gap 120 therebetween.

The work bench 2 is easily adaptable to add more work spaces if required. In particular, the transverse support beams 32 of the outermost leg assemblies 6A, 6C have outwardly facing nut slots 56 that can be used to mount additional longitudinal support beams, work surfaces, and center spline assemblies (not shown), further supported by additional leg assemblies (not shown) spaced longitudinally outward from leg assemblies 6A, 6C. The work bench 2 can be extended in this way to add as many work spaces as required.

The work bench 2 is adapted to permit easy removal of a work space. For example, center spline assembly 8B could be detached from leg assemblies 6B, 6C by removing the bolts 26 from the spline mounting brackets 64. The work surfaces 4C, 4D could also be removed by detaching the corresponding longitudinal support beams 14 from leg assemblies 6B, 6C. With these parts removed, the remaining work bench 2 would have only two work surfaces 4A, 4B providing two work spaces. The smaller work bench 2 could, for example, be placed in a smaller room or area, or could free up additional space for other purposes such as file storage.

In addition to adding and removing work surfaces 4A, 4B, 4C, 4D, the work bench 2 can also be adapted to add various attachments. For example, in the configuration shown in FIGS. 6, 7 and 8, a privacy panel 70 has been inserted into the central groove 68 of the center spline assembly 8A, and a shelving unit 76 has been mounted over the work surface 4A using the L-shaped bracket 74 bolted to a nut 58 in the spline nut slot 72. The longitudinal position of the shelving unit 76 can be selected by sliding the nut 58 to the desired location within the nut slot 72. The shelving unit 76 may, for example, be used to hold books, pictures, or decorations, or may be used as a tray for documents or the like.

Figure 16:
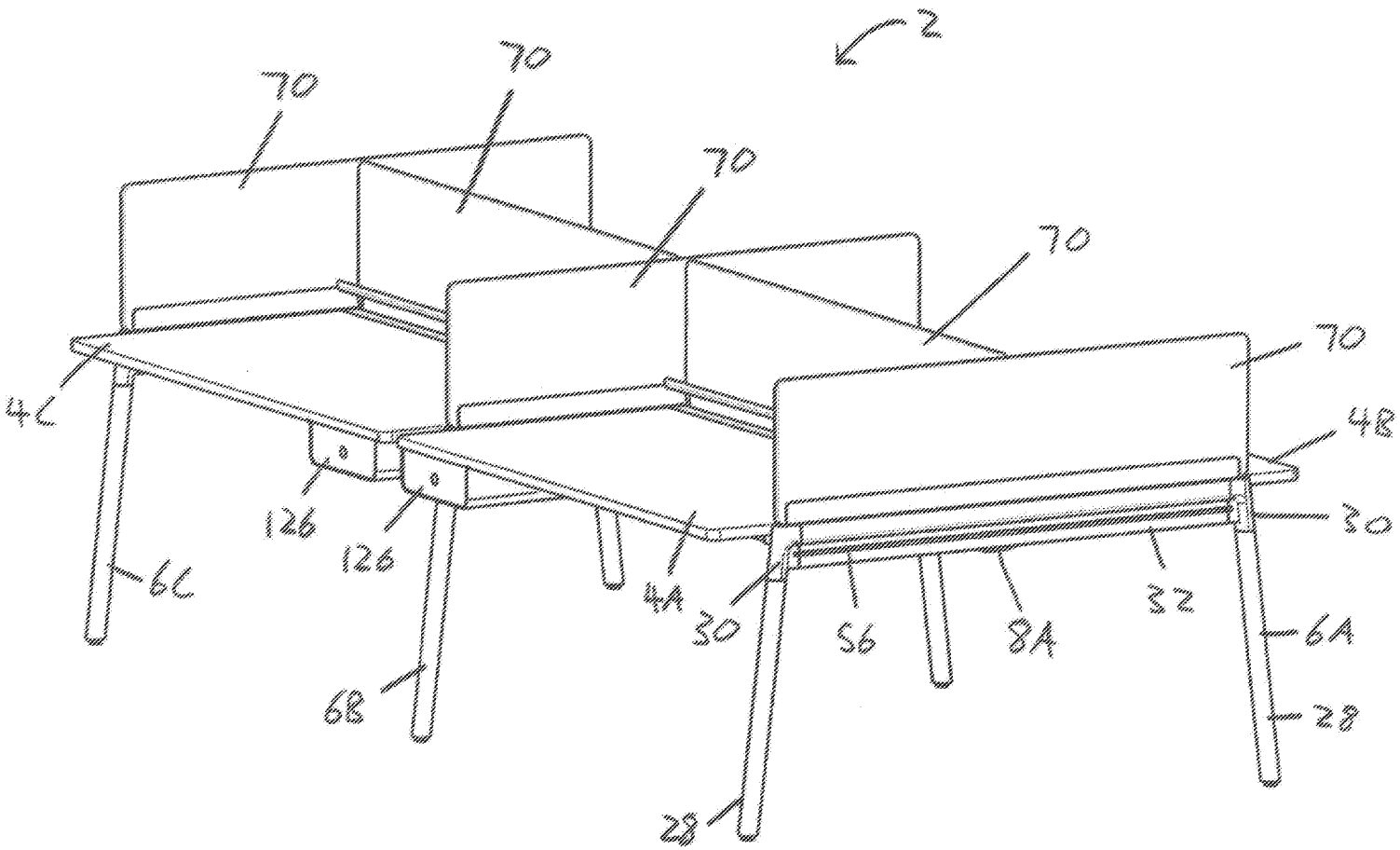
FIG. 16 shows a perspective view of the work bench of FIG. 1 including center and lateral privacy panels and storage drawers 126 in a seventh configuration.

In the configuration shown in FIG. 16, privacy panels 70 have been inserted into the upwardly facing grooves 54 of each of the leg assemblies 6A, 6B, 6C. Modified privacy panels 122 have also been inserted into the central grooves 54 of the center spline assemblies 8A, 8B. The modified privacy panels 122 have built in ledge shelfs 124 that can be used to hold books, documents, tablet computers, or the like. Drawers 126 have also been mounted below the work surfaces 4A, 4B, 4C, 4D for additional storage.

Figure 14:
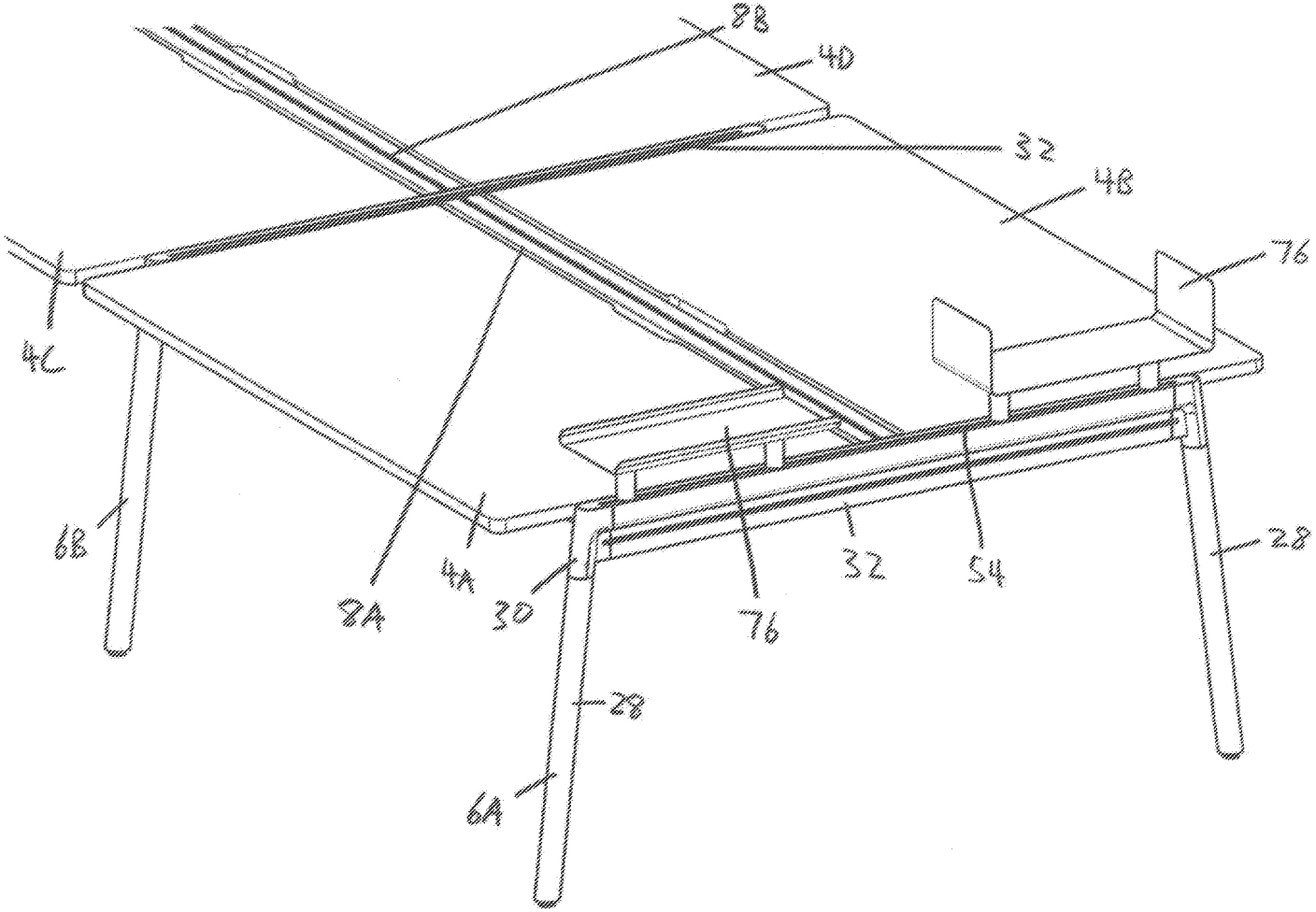
FIG. 14 shows a perspective view of the work bench of FIG. 1 including two shelving units 76 in a fifth configuration.

In the configuration shown in FIG. 12, a privacy panel 70 has been inserted into the upwardly facing groove 54 of leg assembly 6A. In the configuration shown in FIG. 14, shelving units 76 are mounted to the leg assembly 6A in place of the privacy panel 70. These shelving units 76 are adapted to attach to the upwardly facing groove 54 rather than the nut slots 56, 72, and include downwardly extending slot insertion tabs (not shown) for this purpose.

Figure 11:
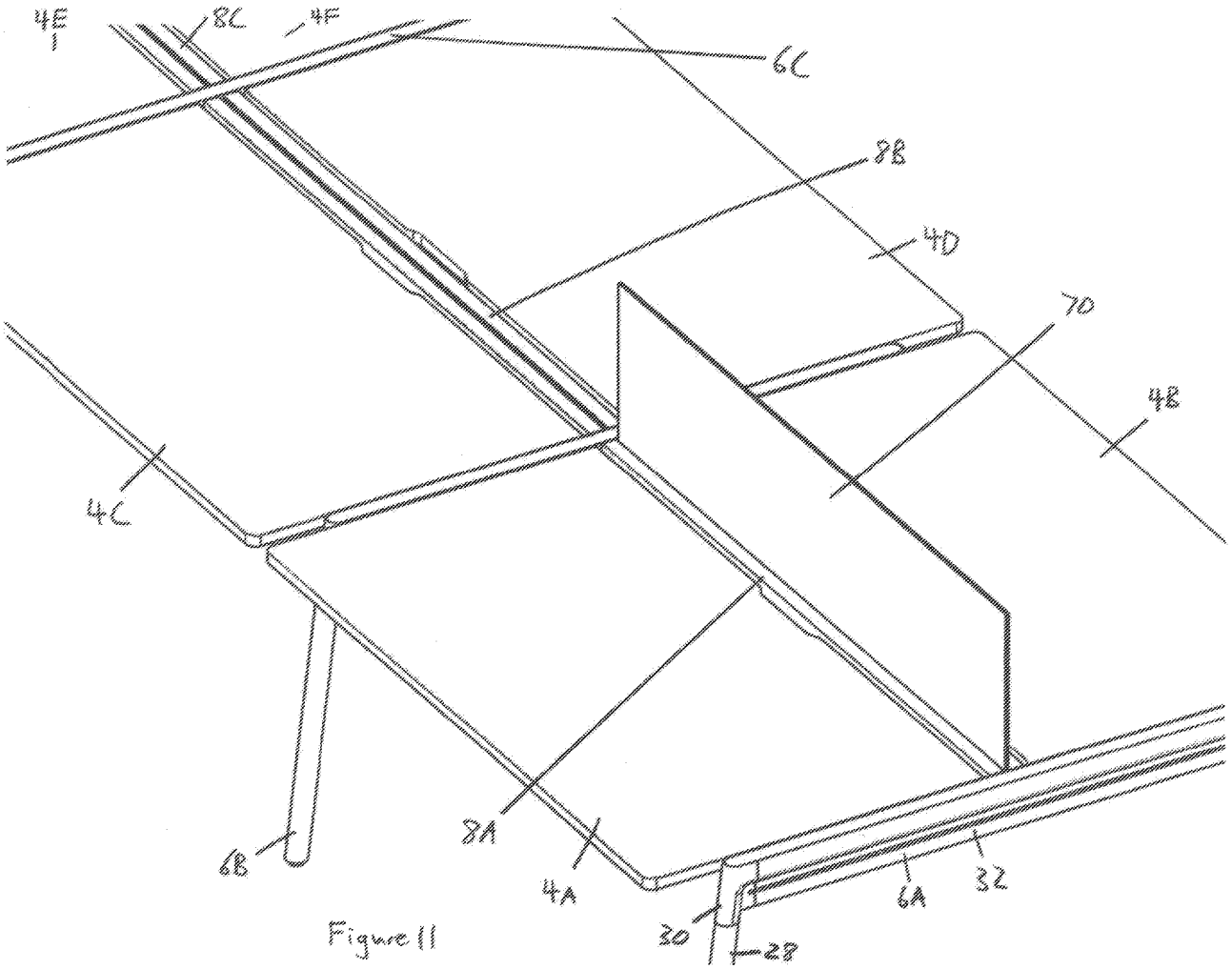
FIG. 11 shows a perspective view of the work bench of FIG. 1 including a center privacy panel in a second configuration.
Figure 13:
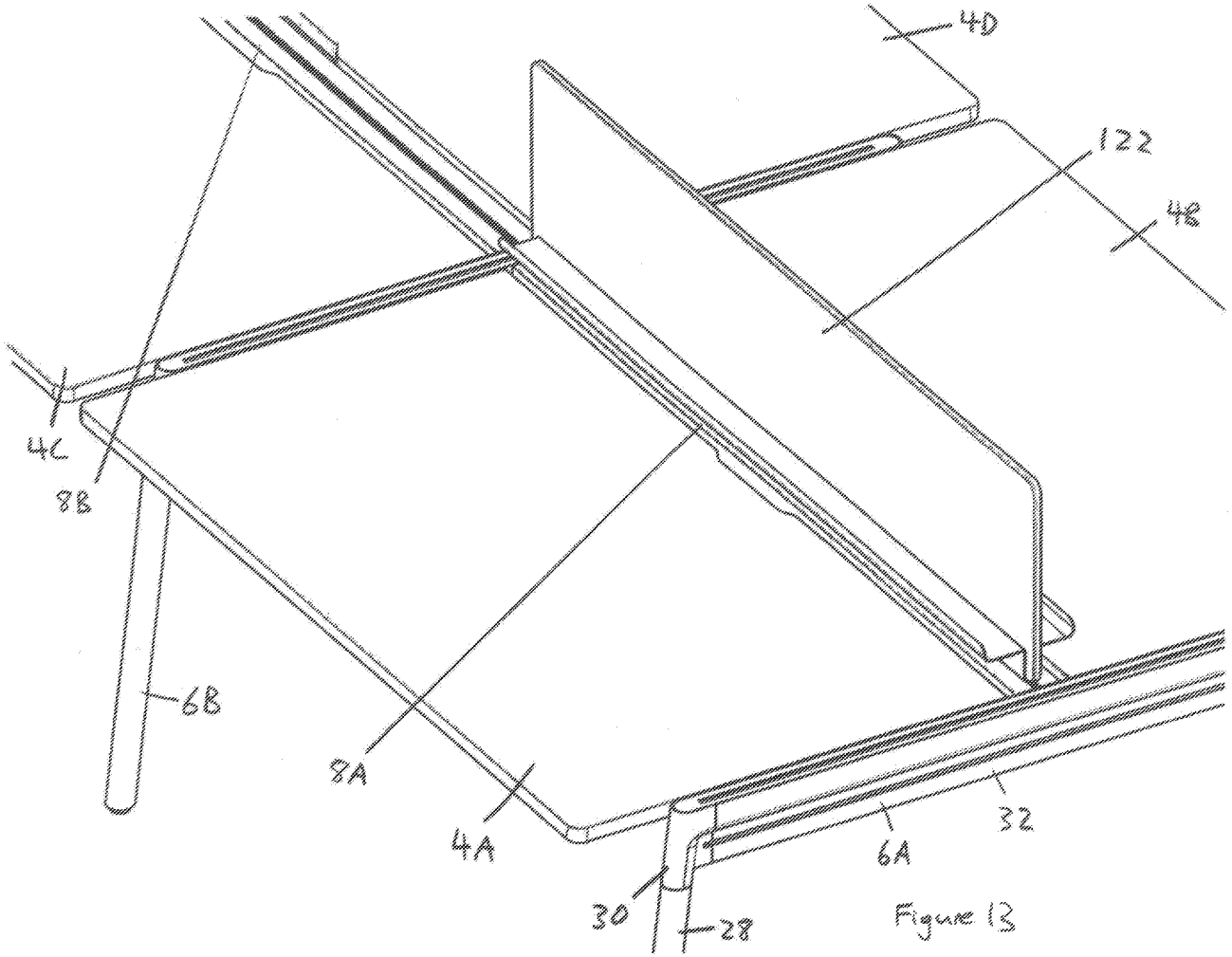
FIG. 13 shows a perspective view of the work bench of FIG. 1 including a center privacy panel 122 in a fourth configuration.

In the configuration shown in FIG. 11, a privacy panel 70 has been inserted into the central groove 68 of the center spline assembly 6A. Also, in this configuration the work bench 2 has been extended by attaching additional work surfaces 4E, 4F and an additional center spline assembly 8C to the leg assembly 6C. The work surfaces 4E, 4F are supported at the other end by an additional leg assembly (not shown). In the configuration shown in FIG. 13, the privacy panel 70 has been replaced with a modified privacy panel 122 with a ledge shelf 124.

Figure 18:
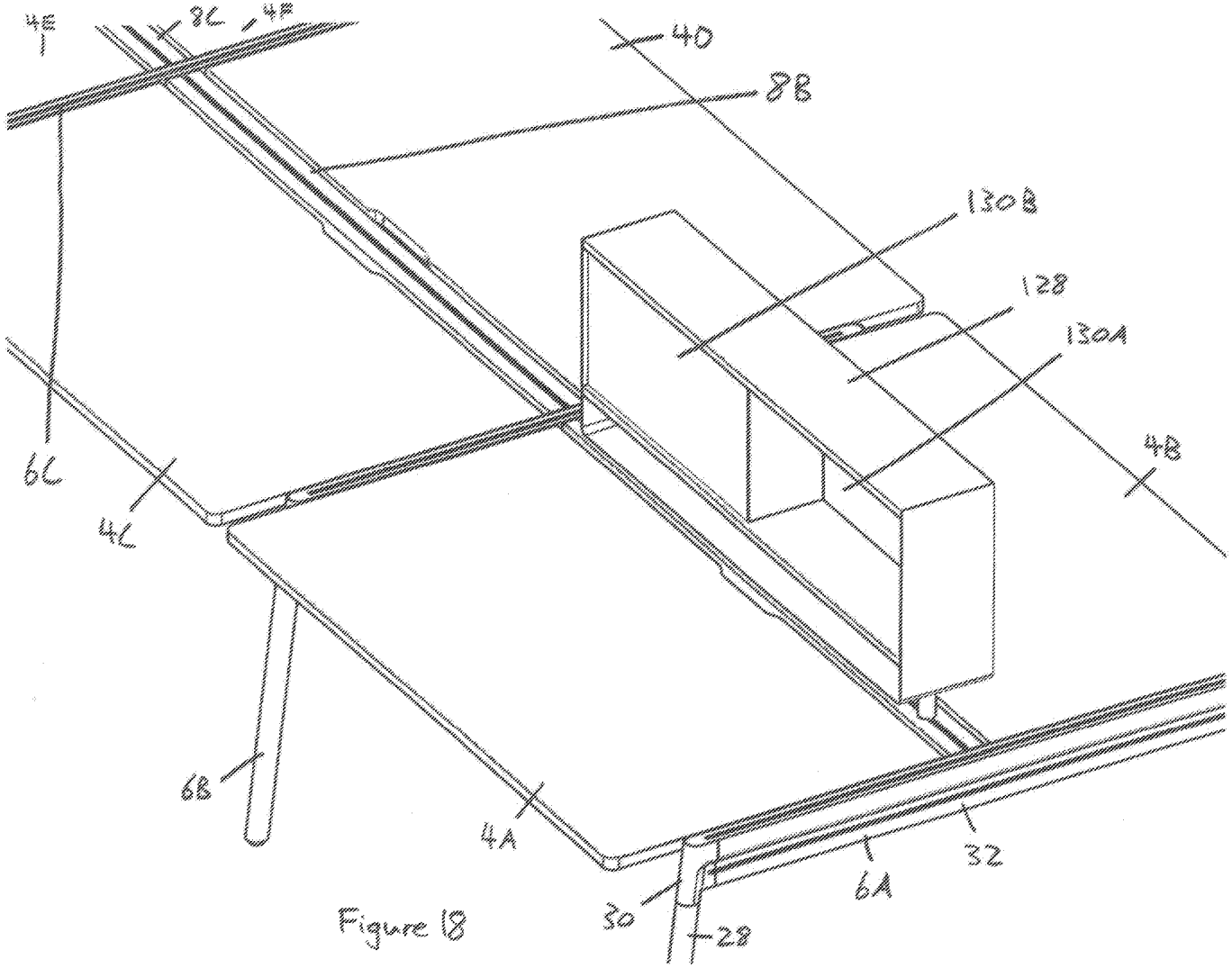
FIG. 18 shows a perspective view of the work bench of FIG. 1 including a center storage cabinet in a ninth configuration.

In the configuration shown in FIG. 18, a split shelf 128 is mounted over the center spine assembly 8A. The split shelf 128 has two compartments 130A, 130B. Compartment 130A is open facing the work surface 4A to provide a space for storing books, plants, and the like, and is closed facing the work surface 4B. Compartment 130B is open facing the work surface 4B, and is closed facing the work surface 4A. Having two oppositely facing compartments 130A, 130B allows the split shelf 128 to provide a storage space for workers on either side of the bench 2. It also acts as a privacy barrier for workers on opposite sides of the shelf 128. The split shelf 128 has downwardly extending slot insertion tabs (not shown) that are inserted into the central groove 68 to hold the shelf 128 in place.

Figure 15:
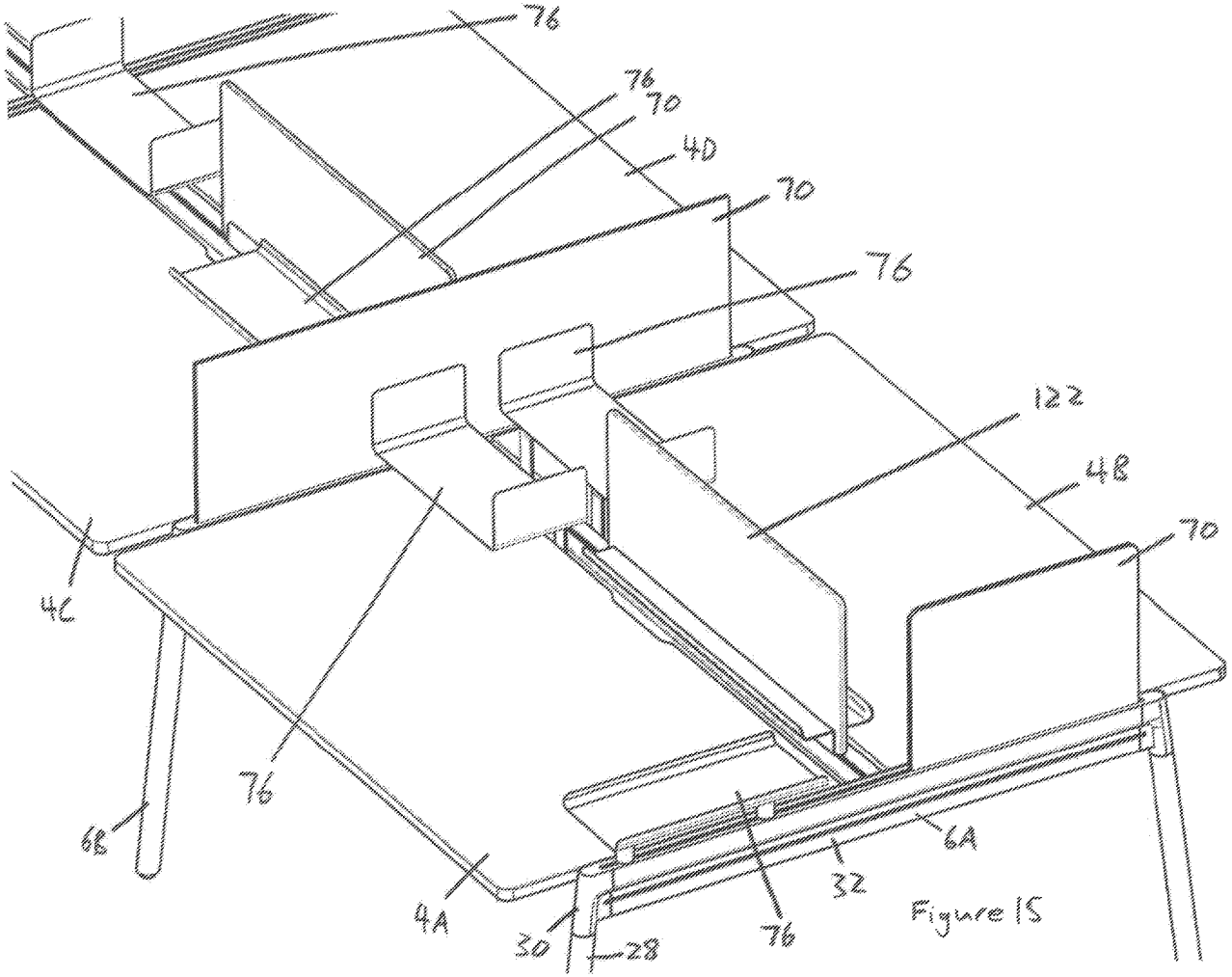
FIG. 15 shows a perspective view of the work bench of FIG. 1 including the center privacy panel 122, shelving units 76 shown on FIG. 6 and lateral privacy panels as in FIG. 12 in a sixth configuration.

The configuration shown in FIG. 15 highlights the adaptability of the work bench 2 to suit different preferences. A modified privacy panel 122 is inserted into the central groove 68 of the center spline assembly 8A, but only extends for part of the length of the center spline assembly 8A. This provides some privacy for the workers on either side of the bench 2, but also allows for some interaction. For example, the partial length of the privacy panel 122 allows materials such as books to be easily shared between the workers on either side using the adjacent shelving units 76. The shelving units 76 are mounted in place using the nut slots 72 on both sides of the center spline assembly 8A. The worker using work surface 4A also has some additional storage space with the shelving unit 76 mounted to the front side of the leg assembly 6A. Meanwhile, the worker using work surface 4B has additional privacy because of the privacy panel 70 mounted to the back side of the leg assembly 6A. A longer privacy panel 70 is inserted into the upwardly facing groove 54 of leg assembly 6B, and an entirely different configuration of shelving units 76 and privacy panels 70, suited to the preferences and needs of the workers using work surfaces 4C, 4D, is provided on the other side.

Figure 17:
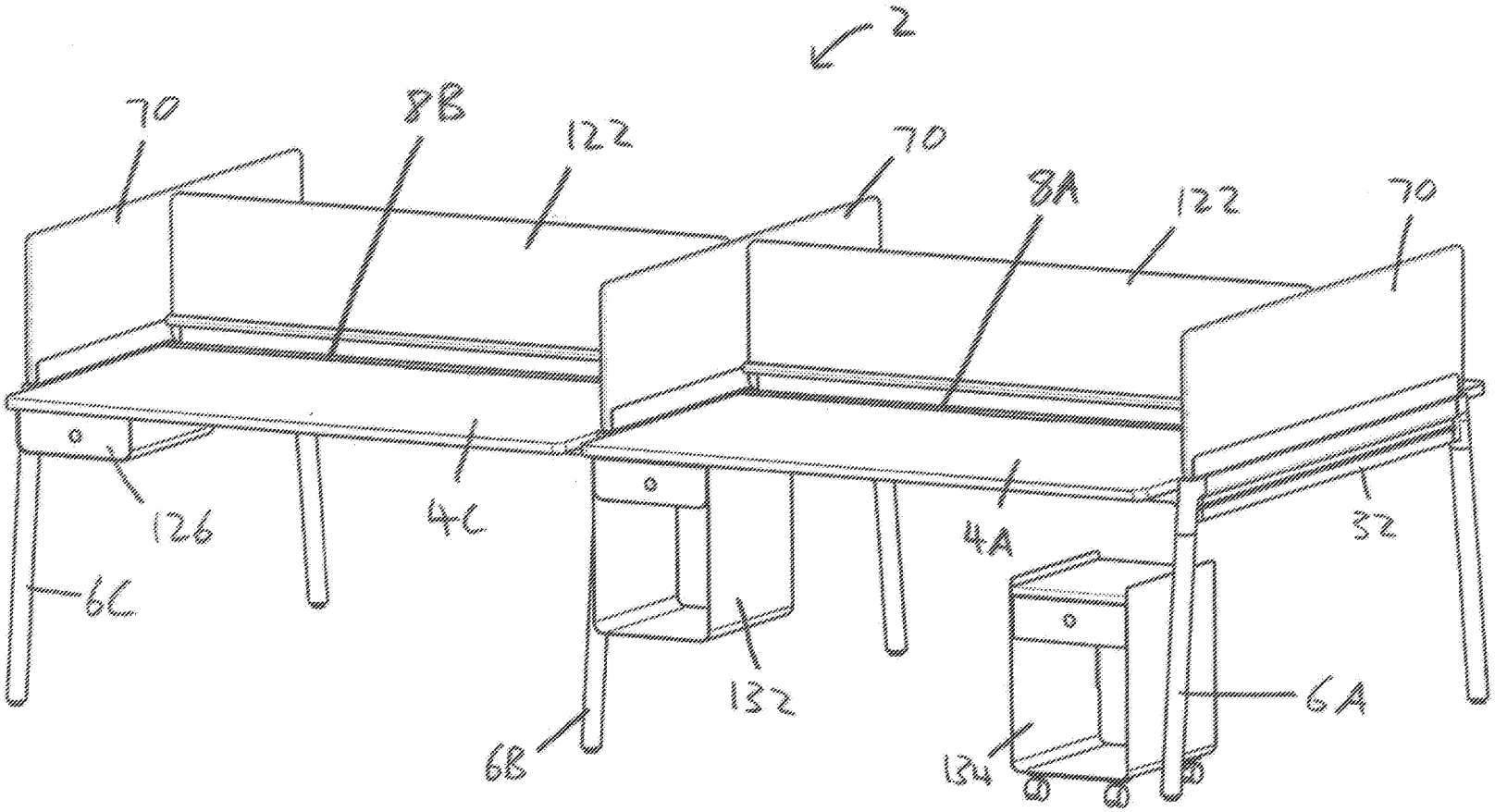
FIG. 17 shows a perspective view of a work bench of FIG. 1 including center and lateral privacy panels, storage drawers 126 and 132 and a freestanding storage module 134 in an eighth configuration.

In the configuration shown in FIG. 17, full length modified privacy panels 122 are inserted into the central grooves 68 of the center spline assemblies 8A, 8B, and full length privacy panels 70 are inserted into the upwardly facing grooves 54 of the leg assemblies 6A, 6B, 6C to provide more traditional cubicle-style work spaces. A drawer 126 is mounted below work surface 4C, and a combined drawer/shelf 132 is mounted below work surface 4A. A rolling storage unit 134 is also placed under work surface 4A to provide additional storage.

Each of the attachments described above could be combined and arranged in any desired configuration. Other attachments not shown could also be secured to the nut slots 56, 72; attached to the grooves 52, 54, 68 or otherwise mounted to the work bench 2, such as lamps and monitor stands.

Figure 19:
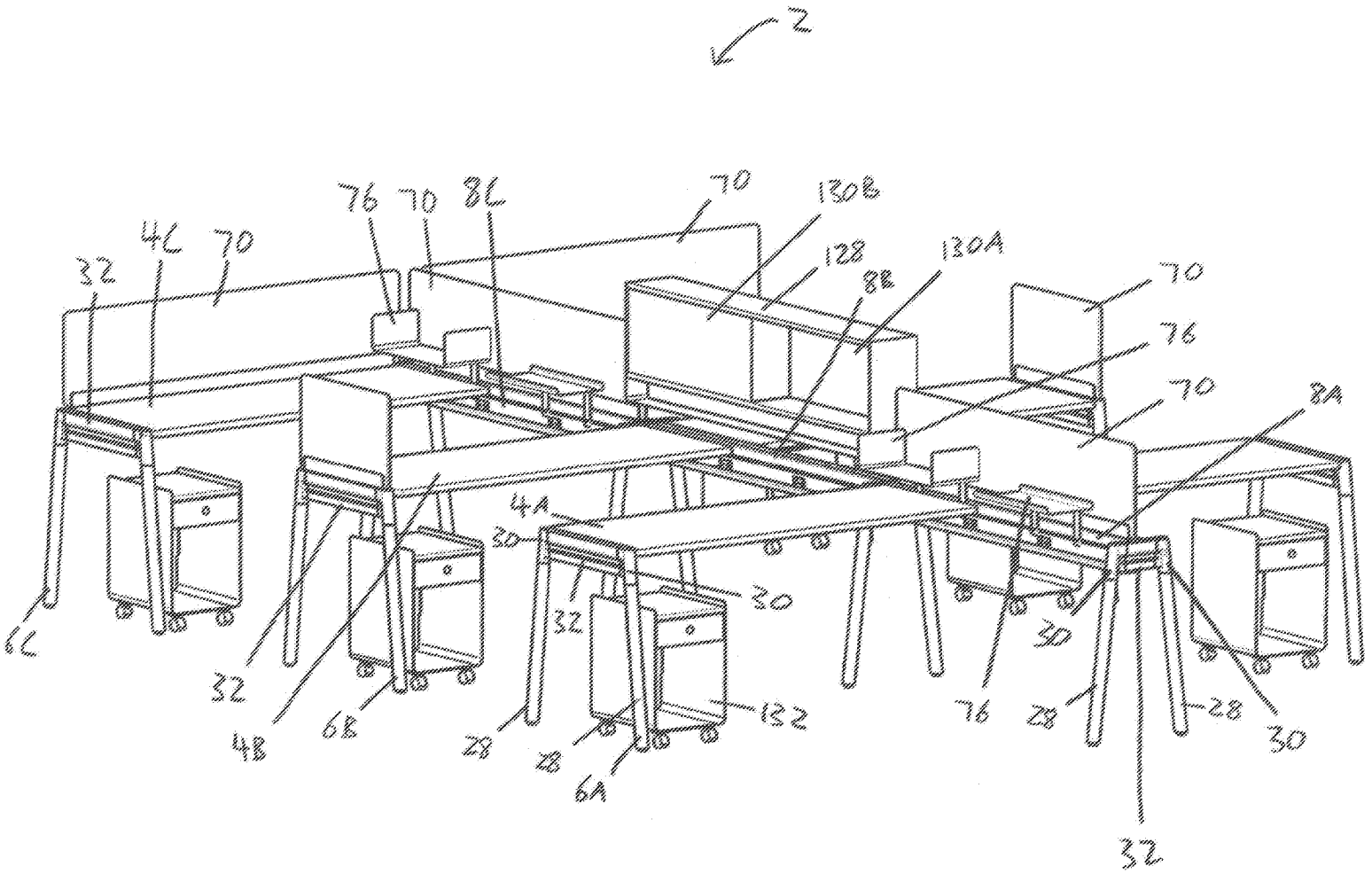
FIG. 19 shows a perspective view of the work bench arrangement in accordance with a second embodiment of the present invention in a tenth configuration.
Figure 20:
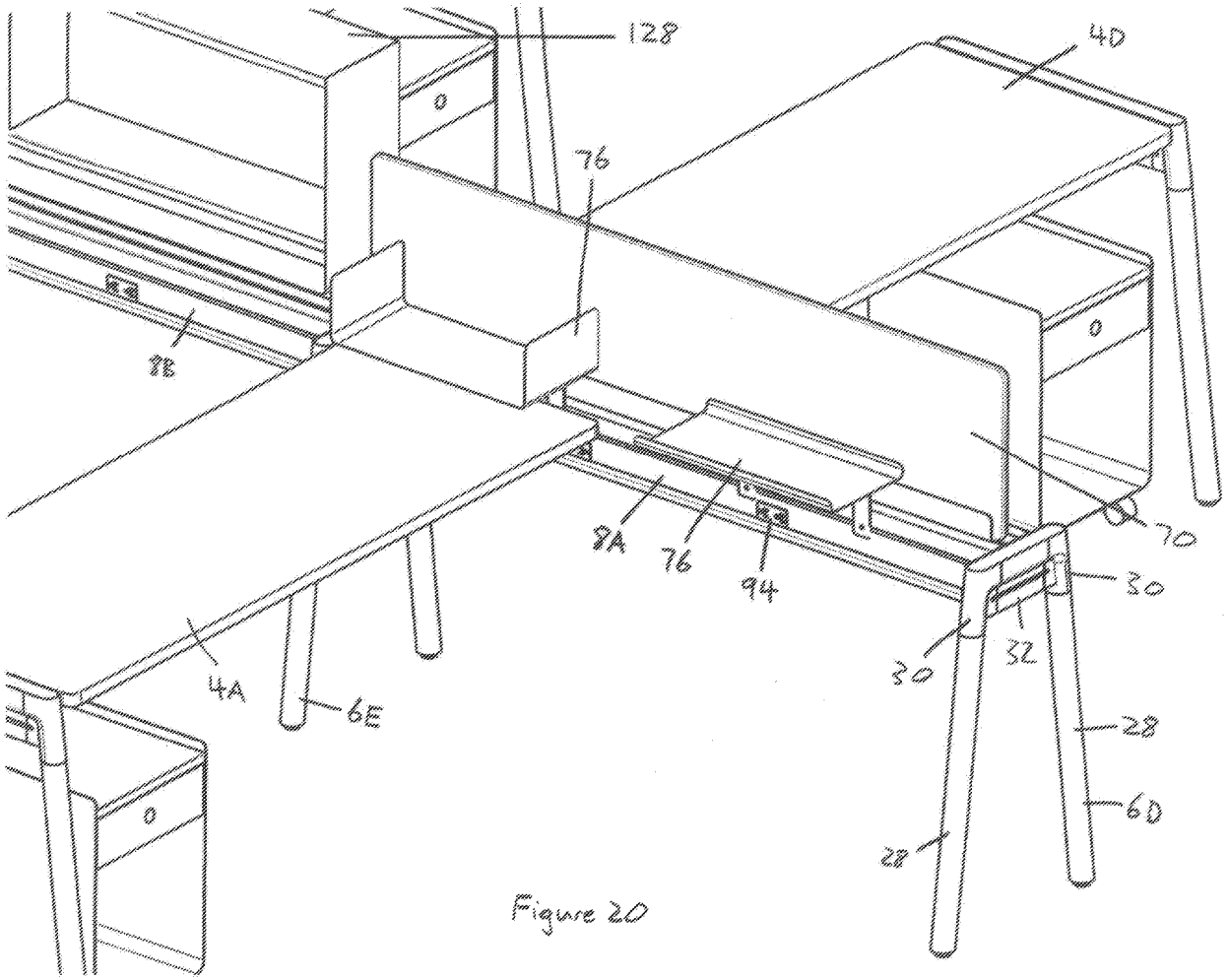
FIG. 20 shows an enlarged perspective view of the work bench of FIG. 19.

The work surfaces 4A, 4B, 4C, 4D, leg assemblies 6A, 6B, 6C, and spline assemblies 8A, 8B could also be arranged in different configurations from those described above. For example, work surfaces 4A, 4B, 4C could be arranged to extend laterally out from the center spline assemblies 8A, 8B, 8C as shown in FIGS. 19 and 20 showing a second embodiment in accordance with the present invention. In this second embodiment of FIGS. 19 and 20, the longitudinal support beams 14 (not shown) supporting the work surfaces 4A, 4B, 4C extend between the leg assemblies 6A, 6B, 6C and corresponding center spline assemblies 8A, 8B, 8B. Meanwhile, the center spline assemblies 8A, 8B, 8C are supported by and extend between a separate set of leg assemblies 6D, 6E, 6F, 6G. The work surfaces 4A, 4B, 4C are spaced from one another so that workers can sit or stand in the spaces between the work surfaces 4A, 4B, 4C. The ends of the longitudinal support beams 14 (not shown) are preferably coupled to the leg assemblies 6A, 6B, 6C by the same mounting bracket 16 as in the first embodiment. The ends of the longitudinal support beams 14 (not shown) are preferably coupled to the center spline assemblies 8A, 8B, 8C by modified mounting brackets which permits bolts through the mounting brackets to engage with nuts 58 in the spline slots 72. With this arrangement power and cabling may be supplied to each work surface 4A, 4B, 4C via the center spline assemblies 8A, 8B, 8C at one end of each work surface 4A, 4B, 4C.

Other embodiments are also possible, such has having work surfaces 4A, 4B, 4C on one side of the center spline assemblies 8A, 8B, 8C extend laterally outwards as in FIG. 19, and work surfaces 4D, 4E, 4F on the other side extend longitudinally along the center spline assemblies 8A, 8B, 8C as in FIG. 1.

The work bench 2 of the second embodiment shown in FIGS. 19 and 20 include leg assemblies 6A, 6B, 6C, 6D, 6E, 6F, 6G with different lengths/proportions relative to the work surfaces from those shown in the first embodiment of FIGS. 1 to 18. In particular, the transverse support beams 32 of the leg assemblies 6A, 6B, 6C supporting the laterally extended ends of the work surfaces 4A, 4B, 4C are relatively shorter than in FIGS. 1 to 18; having a length about the same as the width of one work surface 4A, 4B, 4C. The transverse support beams 32 of the leg assemblies 6D, 6E, 6F, 6G supporting the center spline assemblies 8A, 8B, 8C are shorter still. The remaining bench 2 components, such as the center spline assemblies 8A, 8B, 8C and the work surfaces 4A, 4B, 4C, need not be modified at all for use in each of the first and the second embodiments.

In the second embodiment of FIGS. 19 and 20, some of the work surfaces 4A, 4B, 4C, 4D and their leg assemblies 6A, 6B, 6C, could be removed and free work spaces or free standing desks and seating arrangements could be provided proximate to the spline assemblies 8A, 8B and 8C with the spline assemblies 8A, 8B and 8C providing power and cabling supply, privacy screens and/or shelving/storage cabinets to free standing work spaces.

In the second embodiment of FIGS. 19 and 20, all of the work surfaces 4A, 4B, 4C, 4D and their leg assemblies 6A, 6B, 6C, could be removed and spline assemblies 8A, 8B could be provided separate from any attached work surfaces, as for to provide power and cabling supply, privacy screens and/or shelving/storage cabinets to free standing work spaces, as with free standing desks proximate to the spline assemblies 8A, 8B and 8C. An individual spline assembly 8A would have a single spline assembly with two leg assemblies at its ends and would be self-supporting on a floor with the appearance of a saw-horse. The spline assemblies could comprise but one individual spline assembly 8A, or a number of such spline assemblies in a straight row or connected at their ends at angles to each other. Each individual spline assembly 8A and a straight line of multiple spline assemblies have stability with the legs 28 of each leg assembly extending at an angle to the vertical downwardly away from each other.

Figure 21:
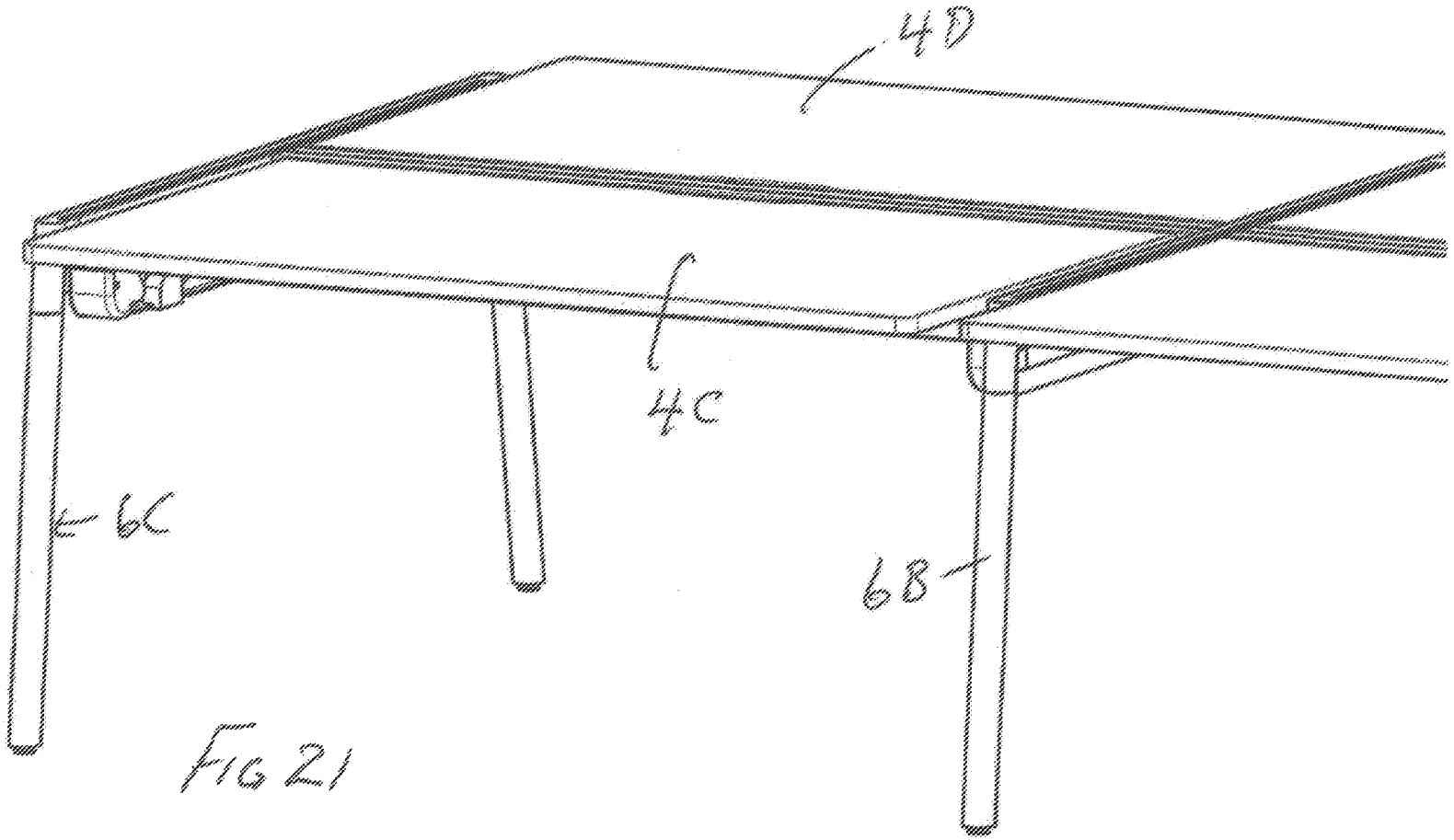
FIG. 21 shows a perspective view of the work bench arrangement in accordance with a third embodiment of the present invention with a work surface in a lower position.
Figure 22:
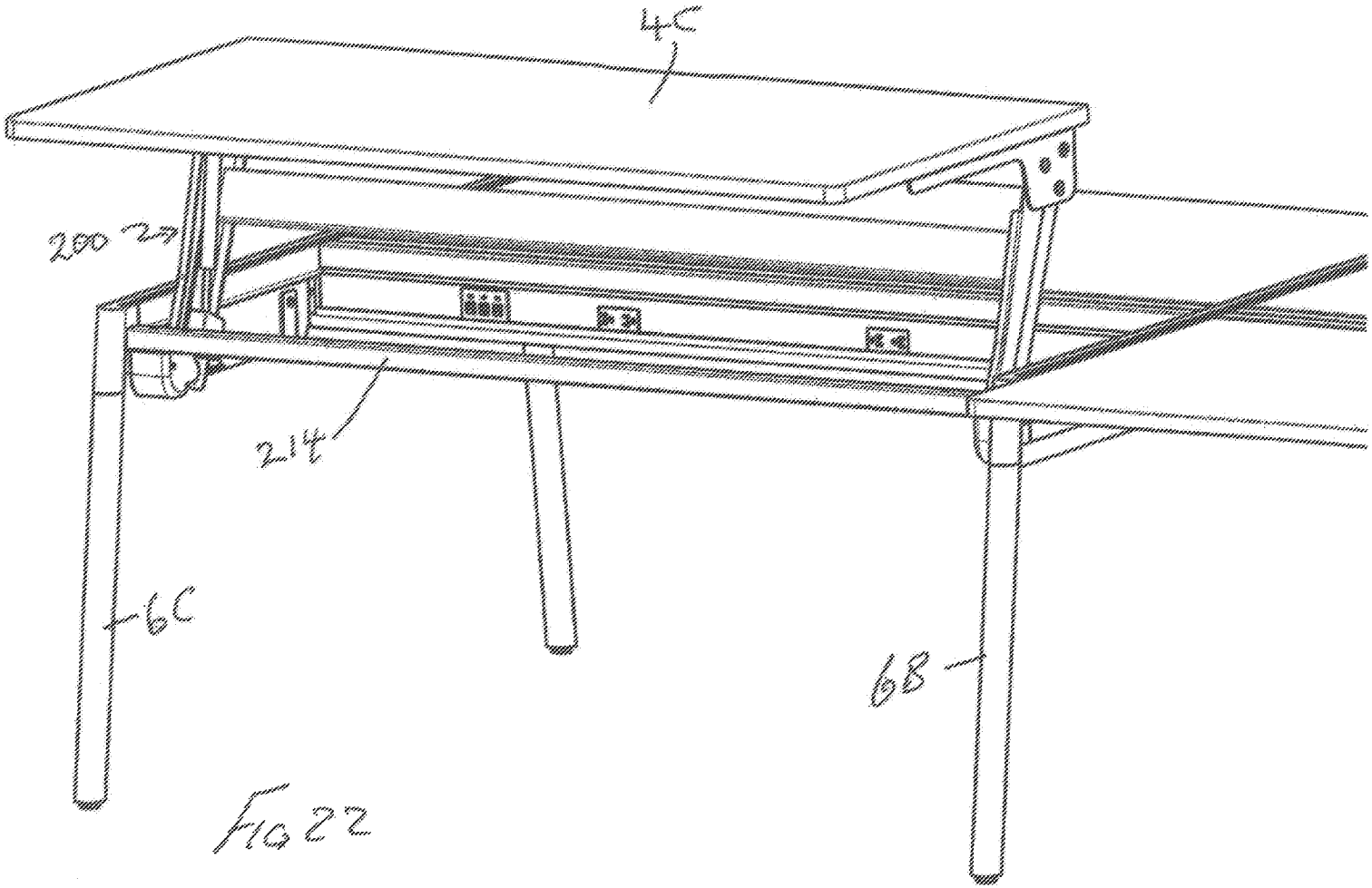
FIG. 22 shows a perspective view of the work bench of FIG. 21 with the work surface in a raised position.
Figure 23:
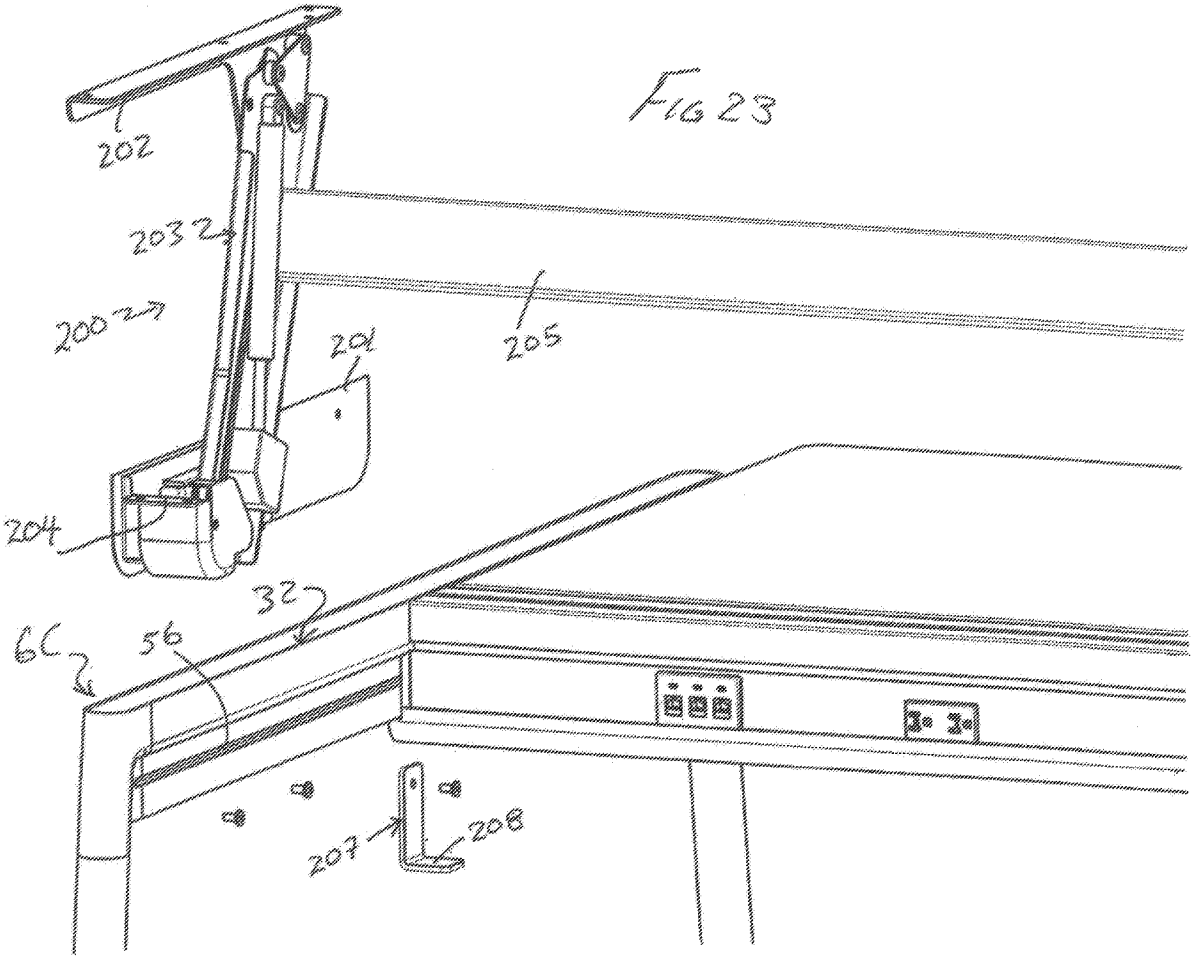
FIG. 23 shows a partial exploded perspective view of components of the work bench in FIG. 22.

Reference is made to FIGS. 21 to 23 showing a work bench arrangement in accordance with a third embodiment of the present invention. The third embodiment is identical to the first embodiment with the exception for the work surface 4C the pair of longitudinal support beams 14 that extend longitudinally under the bottom surface 12 of the work surface 4C and the mounting bracket 16 for each beam have been eliminated and the work surface 4C is mounted between the between two leg assemblies 6B and 6C by a mounting assembly 200 that permits the work surface 4C to be moved between a lower position as seen in FIG. 21 and a raised position as seen in FIG. 23 and supported in each of the lower position and the raised position and intermediate positions between the lower position and the raised position preferably but not necessarily as with a pantograph type arrangement maintaining the work surface 4C disposed to be horizontal. The mounting arrangement 200 includes as seen in FIG. 23: a left lower mounting bracket 201 which is secured to the transverse support beam 32 of the leg assembly 6C via the nut slots 56 using bolts and nuts. The mounting arrangement 200 includes as seen in FIG. 23 a left upper mounting bracket 202 which is secured to the underside of the work surface 4C at its left side. A left bridging mechanism 203 has a lower end coupled to the left lower mounting bracket 201 and an upper end coupled to the left upper mounting bracket 202 such that the work surface 4C is maintained horizontal as it moves between the lower position and the raised position. The mounting arrangement 200 is symmetrical and a right lower mounting bracket, not shown, is provided that is a mirror image to the left lower mounting bracket 201 and secured to the transverse support beam 32 of the leg assembly 6B via the nut slots 56 using bolts and nuts; a right upper mounting bracket not shown is provided that is a mirror image to the left upper mounting bracket 202 and is secured to the underside of the work surface 4C on its right side, and a right bridging mechanism, not shown, is provided that is a mirror image to the left bridging mechanism 203 and has a lower end coupled to the right lower mounting bracket and an upper end coupled to the right upper mounting bracket such that the work surface 4C is maintained horizontal as it moves between the lower position and the raised position.

The left lower mounting bracket 201 and the right lower mounting bracket has an upwardly directed left beam mount surface 204 at its upper forward end and a longitudinal support beam 214 is secured by bolts to beam mount surfaces 204 of the left lower mounting bracket and to a mirror image upwardly directed left beam mount surface 204 on the right lower mounting bracket, not shown, to securely locate the leg assemblies 6B and 6C relative each other at their front ends. A longitudinal support beam 205 also extends between the left bridging mechanism 203 and the right bridging mechanism with its ends fixed to each of the left bridging mechanism 203 and the right bridging mechanism not shown.

The left bridging mechanism 203 includes a piston mechanism 206 whose length varies with movement of the work surface 4C between the lower position and the raised position, with the piston mechanism 203 on one hand exerting forces that assist in raising the work surface 4C to the raised position and on the other hand can preferably keep the work surface in any position unless a minimum force is applied to the work surface 4C.

A left L-shaped shaped stop bracket 207 is secured to the transverse support beam 32 of the leg assembly 6C via the nut slots 56 using a bolt and a nut. The upwardly directed surface 208 of the stop bracket is in opposition to and engages a lower surface of the left bridging mechanism 4C to locate the work surface 4C in the lower position. A mirror image right L-shaped shaped stop bracket not shown is similarly secured to the transverse support beam 32 of the leg assembly 6B.

In use the work surface 4C can be moved between the lower position as seen in FIG. 21 and the raised position as seen in FIG. 23 to be at a desired height for different uses, and for example to be at a raised position for use by a user while standing.

Various different arrangements can be provided in substitution of the mounting assembly 200 shown in the third embodiment supported by the leg assemblies.

Although the Figures show the work bench 2 components as having particular sizes, shapes, configurations and styles, the invention is not limited to these particular sizes, shapes, configurations and styles. Rather, any functional or mechanical equivalents to the work bench 2 as described and illustrated could be used instead. For example, the legs 28 could be made longer so that the work surfaces 4A, 4B, 4C, 4D are at an appropriate height for working while standing; the work surfaces 4A, 4B, 4C, 4D could be made larger, smaller, or a different shape, such as square; or the spline assemblies 8A, 8B could be positioned behind a single work surface 4A rather than between two work surfaces 4A, 4B. These and other modifications which would occur to a person skilled in the art of furniture design are included within the scope of the invention.

Nor is the invention limited to the complete collection of work bench 2 components. Rather, the invention includes within its scope all of the individual components, such as the center spline assembly 8, the leg assembly 6, the work surface 4, the longitudinal support beam 14, the transverse support beam 32, the body 60, and the raceway cover 62, regardless of whether those components are provided as a set or individually.

The invention also includes any and all features, characteristics, and properties of the work bench 2 and the work bench 2 components that are not explicitly identified and described in this document.

While the invention has been described with reference to preferred embodiments, many modifications and variations will now occur to persons skilled in the art. For a definition of the invention, and by way of non-limiting examples, the following claims are included within the scope of the invention:

We claim:

1. A work bench comprising:

a work surface;

a support structure for supporting the work surface; and a spline assembly supported adjacent to the work surface by the support structure, the spline assembly comprising:

a longitudinally extended spline body with an upper portion and two side arms extending downwardly from the upper portion, the spline body defining a channel for carrying a power track between the two side arms; and a longitudinally extended raceway cover configured to attach to the two side arms of the spline body, the raceway cover defining a raceway for carrying cables underneath the spline body;

wherein the spline body is supported adjacent to the work surface so as to provide a gap between the spline body and the work surface;

wherein the upper portion of the spline body has an upper surface with a central groove for receiving a privacy panel; and wherein the upper portion of the spline body defines a nut slot for receiving a nut, the nut slot being configured so that the nut is longitudinally slidable within the nut slot for attachment to a bolt at a selected location.

2. The work bench according to claim 1, wherein the upper portion of the spline body has two laterally spaced sidewalls that extend downwards from the flat upper surface;

wherein the nut slot extends longitudinally along a first one of the sidewalls; and wherein a second nut slot extends longitudinally along a second one of the sidewalls.

3. The work bench according to claim 1, wherein the nut slot is configured for mounting an accessory proximate to the work surface at the selected location using the nut and the bolt.

4. The work bench according to claim 3, wherein the accessory comprises a shelf, a tray, or a bracket.

5. The work bench according to claim 3, wherein the nut slot is located below the work surface so that the accessory extends up through the gap when mounted at the selected location.

6. The work bench according to claim 1, wherein the spline body is configured to slidably receive the power track into the channel by inserting the power track upwards between the two side arms while the raceway cover is unattached to the side arms.

7. The work bench according to claim 6, wherein a first one of the side arms has a first side slot that extends laterally through the first side arm, extends longitudinally between a first end edge and a second end edge, and extends upwardly from a slot opening at a lower end of the first side arm to an inner edge spaced upwardly from the slot opening, the first side slot being configured to receive a laterally extending power socket of the power track when the power track is inserted upwards into the channel, the first side slot is located proximate to the gap so that the power socket is accessible from the work surface through the gap.

8. The work bench according to claim 7, wherein a second one of the side arms has a second side slot that extends laterally through the second side arm, extends longitudinally between a first end edge and a second end edge, and extends upwardly from a slot opening at a lower end of the second side arm to an inner edge spaced upwardly from the slot opening, the second side slot being configured to receive a second laterally extending power socket of the power track when the power track is inserted upwards into the channel, the second side slot is located proximate to the gap so that the power socket is accessible from the work surface through the gap.

9. The work bench according to claim 6, wherein the upper portion of the spline body has an attachment mechanism for carrying the power track within the channel.

10. The work bench according to claim 6, wherein the spline assembly further comprises a retainer configured to hang from a connector on a bottom surface of the power track, the retainer being configured to hold the cables in place underneath the spline body when the raceway cover is unattached to the side arms.

11. The work bench according to claim 10, wherein the retainer is positioned within the raceway and is configured to hold the cables within the raceway, between the raceway cover and the side arms.

12. The work bench according to claim 11, further comprising at least one additional retainer, wherein the retainers are longitudinally spaced from one another within the raceway, and wherein each retainer has two laterally extending arms that are configured to support data cables, and a central slotway that is configured to support a power cable.

13. The work bench according to claim 1, wherein the raceway cover is open at its longitudinal ends, the support structure comprises a support beam, the raceway cover being normal to the support beam; and wherein the raceway cover extends below a height of the support beam so as to allow the cables to pass horizontally under the support beam from the open end of the raceway cover.

14. The work bench according to claim 13, further comprising a second work surface that is supported by the support structure adjacent to the spline body so as to provide a second gap between the second work surface and the spline body, with the spline body arranged between the work surface and the second work surface.

15. The work bench according to claim 14, wherein the support structure comprises a first leg assembly attached to a first longitudinal end of the spline body and a second leg assembly attached to a second longitudinal end of the spline body, each of the first and second leg assemblies comprising a transverse support beam extending laterally between a front leg and a back leg;

wherein the work surface is supported between the transverse support beam of the first leg assembly and the transverse support beam of the second leg assembly at a front side of the work bench; and wherein the second work surface is supported between the transverse support beam of the first leg assembly and the transverse support beam of the second leg assembly at a back side of the work bench;

the work bench further comprising a third leg assembly, a second spline assembly, a third work surface, and a fourth work surface;

wherein the first longitudinal end of the spline body of the spline assembly is attached to a first side of the transverse support beam of the first leg assembly;

wherein the second longitudinal end of the spline body of the spline assembly is attached to a first side of the transverse support beam of the second leg assembly;

wherein the first longitudinal end of the spline body of the second spline assembly is attached to a second side of the transverse support beam of the second leg assembly;

wherein the second longitudinal end of the spline body of the second spline assembly is attached to a first side of the transverse support beam of the third leg assembly;

wherein the third work surface is supported between the transverse support beam of the second leg assembly and the transverse support beam of the third leg assembly at the front side of the work bench;

wherein the fourth work surface is supported between the transverse support beam of the second leg assembly and the transverse support beam of the third leg assembly at the back side of the work bench; and wherein the raceway of the spline assembly and the raceway of the second spline assembly extend below a bottom surface of the transverse support beam of the second leg assembly, so as to allow the cables carried by the raceways to extend between the spline assembly and the second spline assembly underneath the transverse support beam.

16. A work bench comprising:

a work surface;

a support structure for supporting the work surface; and a spline assembly supported adjacent to the work surface by the support structure, the spline assembly comprising:

a longitudinally extended spline body with an upper portion and two side arms extending downwardly from the upper portion, the spline body defining a channel for carrying a power track between the two side arms; and a longitudinally extended raceway cover configured to attach to the two side arms of the spline body, the raceway cover defining a raceway for carrying cables underneath the spline body;

wherein the spline body is configured to slidably receive the power track into the channel by inserting the power track upwards between the two side arms while the raceway cover is unattached to the side arms; and wherein the spline assembly further comprises a retainer configured to hang from a connector on a bottom surface of the power track, the retainer being configured to hold the cables in place underneath the spline body when the raceway cover is unattached to the side arms.

17. A work bench comprising:

a work surface;

a support structure for supporting the work surface; and a spline assembly supported adjacent to the work surface by the support structure so as to provide a gap between the spline body and the work surface, the spline assembly comprising:

a longitudinally extended spline body with an upper portion and two side arms extending downwardly from the upper portion, the spline body defining a channel between the two side arms;

a power track positioned within the channel, the power track having at least one power outlet that is accessible from the work surface through the gap; and a longitudinally extended raceway cover configured to attach to the two side arms of the spline body, the raceway cover defining a raceway for carrying cables underneath the power track;

wherein the upper portion of the spline body has a flat upper surface with a central groove for receiving a privacy panel;

wherein the upper portion of the spline body defines a nut slot for receiving a nut, the nut slot being configured so that the nut is longitudinally slidable within the nut slot for attachment to a bolt at a selected location;

wherein at least one of the side arms has at least one side slot that extends laterally through the side arm, extends longitudinally between a first end edge and a second end edge, and extends upwardly from a slot opening at a lower end of the side arm to an inner edge spaced upwardly from the slot opening, the at least one side slot being configured to receive the at least one power outlet of the power track;

wherein the upper portion of the spline body has an attachment mechanism for carrying the power track within the channel;

wherein the spline assembly further comprises a retainer configured to hang from a connector on a bottom surface of the power track, the retainer being configured to hold the cables within the raceway, between the raceway cover and the side arms;

wherein the support structure comprises a first leg assembly attached to a first longitudinal end of the spline body and a second leg assembly attached to a second longitudinal end of the spline body, each of the first and second leg assemblies comprising a transverse support beam extending laterally between a front leg and a back leg; and wherein the raceway cover has open longitudinal ends that extend below a height of the transverse support beams so as to allow the cables to pass horizontally under the transverse support beams from the open ends of the raceway cover.

18. The work bench according to claim 16, wherein a first one of the side arms has a first side slot that extends laterally through the first side arm, extends longitudinally between a first end edge and a second end edge, and extends upwardly from a slot opening at a lower end of the first side arm to an inner edge spaced upwardly from the slot opening, the first side slot being configured to receive a laterally extending power socket of the power track when the power track is inserted upwards into the channel, the first side slot is located proximate to the gap so that the power socket is accessible from the work surface through the gap.

19. The work bench according to claim 16, wherein the retainer is positioned within the raceway and is configured to hold the cables within the raceway, between the raceway cover and the side arms.

20. The work bench according to claim 19, further comprising at least one additional retainer, wherein the retainers are longitudinally spaced from one another within the raceway, and wherein each retainer has two laterally extending arms that are configured to support data cables, and a central slotway that is configured to support a power cable.

* * * * *